US008911572B2

(12) United States Patent
Kim et al.

(10) Patent No.: US 8,911,572 B2
(45) **Date of Patent: *Dec. 16, 2014**

(54) TOUGH IRON-BASED BULK METALLIC GLASS ALLOYS

(75) Inventors: Samuel T. Kim, Aliso Viejo, CA (US); Marios D. Demetriou, Los Angeles, CA (US); William L. Johnson, San Marino, CA (US)

(73) Assignee: California Institute of Technology, Pasadena, CA (US)

( * ) Notice: Subject to any disclaimer, the term of this patent is extended or adjusted under 35 U.S.C. 154(b) by 247 days.

This patent is subject to a terminal disclaimer.

(21) Appl. No.: 13/246,446

(22) Filed: Sep. 27, 2011

(65) Prior Publication Data

US 2012/0073710 A1 Mar. 29, 2012

Related U.S. Application Data

(63) Continuation-in-part of application No. 12/783,007, filed on May 19, 2010, now Pat. No. 8,529,712.

(60) Provisional application No. 61/386,910, filed on Sep. 27, 2010, provisional application No. 61/179,655, filed on May 19, 2009.

(51) Int. Cl.
*C22C 45/02* (2006.01)
*C22C 38/08* (2006.01)

(52) U.S. Cl.
CPC ..... *C22C 45/02* (2013.01); *C22C 38/08* (2013.01)
USPC ..... 148/561; 148/304; 148/403; 164/61

(58) Field of Classification Search
None
See application file for complete search history.

(56) References Cited

U.S. PATENT DOCUMENTS

| | | | | |
|---|---|---|---|---|
| 4,152,144 | A * | 5/1979 | Hasegawa et al. | 148/304 |
| 5,961,745 | A | 10/1999 | Inoue et al. | |
| 6,053,989 | A * | 4/2000 | Orillion et al. | 148/304 |
| 6,077,367 | A | 6/2000 | Mizushima et al. | |
| 7,282,103 | B2 | 10/2007 | Sakamoto et al. | |
| 7,622,011 | B2 | 11/2009 | Inoue et al. | |

(Continued)

FOREIGN PATENT DOCUMENTS

| | | | |
|---|---|---|---|
| CN | 1442866 | A | 9/2003 |
| CN | 101289718 | A | 10/2008 |

(Continued)

OTHER PUBLICATIONS

International Search Report and Written Opinion dated Dec. 29, 2010, PCT/US2010/035382, 7 pages.

(Continued)

*Primary Examiner* — George Wyszomierski
(74) *Attorney, Agent, or Firm* — Polsinelli PC

(57) ABSTRACT

A family of iron-based, phosphor-containing bulk metallic glasses having excellent processability and toughness, methods for forming such alloys, and processes for manufacturing articles therefrom are provided. The inventive iron-based alloy is based on the observation that by very tightly controlling the composition of the metalloid moiety of the Fe-based, P-containing bulk metallic glass alloys it is possible to obtain highly processable alloys with surprisingly low shear modulus and high toughness. Further, by incorporating small fractions of silicon (Si) and cobalt (Co) into the Fe—Ni—Mo—P—C—B system, alloys of 3 and 4 mm have been synthesized with high saturation magnetization and low switching losses.

27 Claims, 14 Drawing Sheets

(56) References Cited

U.S. PATENT DOCUMENTS

| | | | | |
|---|---|---|---|---|
| 7,918,946 | B2 | 4/2011 | Sato | |
| 8,529,712 | B2 * | 9/2013 | Demetriou et al. | 148/541 |
| 2007/0079907 | A1 * | 4/2007 | Johnson et al. | 148/403 |
| 2010/0300148 | A1 | 12/2010 | Demetriou et al. | |

FOREIGN PATENT DOCUMENTS

| | | |
|---|---|---|
| EP | 0747498 | 12/1996 |
| JP | 08-333660 | 12/1996 |
| JP | 11-071657 | 3/1999 |
| JP | 11-293427 | 10/1999 |
| JP | 2001-338808 | 12/2001 |
| JP | 2005-264260 | 9/2005 |
| JP | 2005-290468 | 10/2005 |
| KR | 10-0582579 | 5/2006 |
| KR | 10-2009-0038016 | 4/2009 |
| WO | WO 99/02748 | 1/1999 |

OTHER PUBLICATIONS

Gu et al., "Ductility improvement of amorphous steels: roles of shear modulus and electronic structure," *Acta Materialia*, 2008, 56:88-94.
Makino et al., "Fe-Metalloid Metallic Glasses with High Magnetic Flux Density and High Glass-Forming Ability," *Materials Science Forum*, 2007, 561-565:1361-1366.

* cited by examiner

TOUGH IRON-BASED BULK METALLIC GLASS ALLOYS

CROSS-REFERENCE TO RELATED APPLICATION

The current application is a continuation-in-part of U.S. patent application Ser. No. 12/783,007, filed May 19, 2010, which claims priority to U.S. Provisional Application No. 61/179,655, filed May 19, 2009, the disclosures of which are incorporated herein by reference. The application also claims priority to U.S. Provisional Application No. 61/386,910, filed Sep. 27, 2010, the disclosure of which is incorporated herein by reference.

FIELD OF THE INVENTION

This invention relates generally to an iron-based bulk metallic glass alloy; and more particularly to a family of iron-based phosphor containing bulk metallic glass alloys exhibiting low shear moduli.

BACKGROUND OF THE INVENTION

Metal alloys are usually in a crystalline state in which the atoms are structured in an ordered and repeating pattern. In contrast, amorphous alloys consist of randomly arranged atoms without any structure or repeating pattern. This can occur when the molten alloy is cooled at a sufficiently high rate to prevent the atoms from arranging into ordered patterns and thus bypassing crystallization. The discovery of the "metallic" glass in 1960 led to a "metallically" bonded amorphous solid with thermodynamic and kinetic properties similar to common silicate glasses, but with fundamentally different mechanical, electronic, and optical properties. (See, W. Klement, et al., *Nature* 187, 869-870 (1960), the disclosure of which is incorporated herein by reference). Metallic glasses are electronically and optically "metallic" like ordinary metals, and exhibit fracture toughness considerably higher than silicate glasses. Owing to the lack of long-range atomic order and the absence of microscopic defects such as vacancies, dislocation, or grain boundaries, metallic glasses exhibit engineering properties such as strength, hardness, and elasticity that are significantly enhanced compared to conventional metals. The absence of microstructural defects influences their chemical behavior as well, often resulting in improved resistance to corrosion and chemical attack. (See, e.g., W. L. Johnson, *MRS Bull.* 24, 42-56 (1999); W. L. Johnson, *JOM* 54, 40-43 (2002); A. L. Greer & E. Ma, *MRS Bull.* 32, 611-616 (2007); and A. L. Greer, *Today* 12, 14-22 (2009), the disclosures of each of which are incorporated herein by reference).

The remarkably high strength, modulus, and hardness of iron-based glasses, combined with their low cost, prompted an effort over the last five years to design amorphous steel suitable for structural applications. The alloy development effort yielded glasses with critical rod diameters as large as 12 mm and strengths in excess of 4 GPa. (See, e.g., Lu Z P, et al., *Phys Rev Lett* 92; 245503 (2004); Ponnambalam V, et al., *J Mater Res* 19; 1320 (2004); and Gu X J, et al., *J Mater Res.* 22; 344 (2007), the disclosures of each of which are incorporated herein by reference). These low-cost ultra-strong materials, however, exhibit fracture toughness values as low as 3 MPa $m^{1/2}$, which are well below the lowest acceptable toughness limit for a structural material. (See, e.g., Hess P A, et al., *J Mater Res.* 2005:20; 783, the disclosure of which is incorporated herein by reference). The low toughness of these glasses has been linked to their elastic constants, specifically their high shear modulus, which for some compositions was reported to exceed 80 GPa. (See, e.g., Gu X J, et al., *Acta Mater* 56; 88 (2008), the disclosure of which is incorporated herein by reference). Recent efforts to toughen these alloys by altering their elemental composition yielded glasses with lower shear moduli (below 70 GPa), which exhibit improved notch toughness (as high as 50 MPa $m^{1/2}$), but compromised glass forming ability (critical rod diameters of less than 3 mm). (See, e.g., Lewandowski J J, et al., *Appl Phys Lett* 92; 091918 (2008), the disclosure of which is incorporated herein by reference).

Another feature of metallic glasses originating from the lack of crystalline periodicity in the atomic structure is a unique soft magnetic behavior of ferrous-metal glasses. Convincing evidence for magnetic ordering in an amorphous metal was first provided by Duwez and Lin in 1967, who successfully produced an amorphous ferromagnetic Fe—P—C foil. (See, P. Duwez & S. C. H. Lin, *J. Appl. Phys.* 38, 4096-4097 (1967), the disclosure of which is incorporated herein by reference). Duwez and Lin not only demonstrated ferromagnetism in glassy Fe—P—C, but also unusually soft magnetic properties. Because of the absence of a crystal lattice, the magnetic moment in amorphous ferromagnets is not coupled to a particular structural direction, so there is no magneto-crystalline anisotropy. (See, H. Warlimont, *Mater. Sci. Eng.* 99, 1-10 (1988) the disclosure of which is incorporated herein by reference). Moreover, since the material is magnetically homogeneous at length scales comparable to the magnetic correlation length, the intrinsic coercivity is small. Consequently, amorphous ferromagnetic cores exhibit soft magnetic behavior characterized by high saturation magnetization, desirable for higher power cores with smaller sizes, low coercivity, low magnetic remanence, and small hysteresis, all of which lead to very low core losses and high efficiencies. Due to their superior soft magnetic properties, amorphous metal alloys have been a topic of high interest and have replaced conventional materials in transformer and inductor cores for applications where high performance is required. (See, R. Hasegawa, *Journal of Magnetism and Magnetic Materials*, vol. 215-216, June, pp. 240-245, (2000), the disclosure of which is incorporated herein by reference). Additionally, these materials may also have applications in sensors, surveillance systems, and communication equipment. (See, H. Warlimont, *Materials Science and Engineering*, vol. 99, March, pp. 1-10, (1988), the disclosure of which is incorporated herein by reference). As such, amorphous ferromagnetic components are currently used widely in power electronics, telecommunication equipment, sensing devices, electronic article surveillance systems, etc. (See, R. Hasegawa, "Present Status of Amorphous Soft Magnetic Alloys," *J. Magn. Magn. Mater.* 215-216, 240-245 (2000), the disclosure of which is incorporated herein by reference). Amorphous magnetic inductors also find applications in pulse power devices, automotive ignition coils, and electric power conditioning systems. All of these applications are possible because of faster flux reversal, lower magnetic losses, and more versatile property modification achievable in amorphous ferromagnets.

Despite all these promising applications, processing techniques and economic viability of incumbent amorphous alloys have limited their impact in industry so far. The early amorphous ferromagnetic alloys introduced in the 1980s were available only in ribbon form with thicknesses of tens of micrometers, owing to its very limited glass forming ability. These ribbons, commercialized under the trade-name Metglas™, were produced by melt spinning on a copper wheel which resulted in melt quenching at rates of $10^3$-$10^5$ K/s. Amorphous cores were produced by concentrically laminating these ribbons around a mandrel forming cores of desired shapes and sizes. Although successful, this process had inherent deficiencies: a laborious and expensive laminating process and a low core-packing density due to air gaps left between the thin foils needed to build up the core, which reduces the overall core efficiency. To overcome these deficiencies associated with thin ribbons, the development of ferromagnetic glasses with more robust glass forming ability has been sought in the recent years. For example, Shen and Schwarz reported a ferromagnetic metallic glass capable of forming bulk three-dimensional amorphous hardware with thicknesses up to 4 mm. (See, T. D. Shen & R. B. Schwarz, *Appl. Phys. Lett.* 75, 49-51 (1999), the disclosure of which is incorporated herein by reference). Although the new bulk glass formers appeared very promising in overcoming the problems of the early ribbons, they suffered from a deficiency of their own: a low fracture toughness, resulting in difficult handling and early fatigue failure.

Over the last three years, significant effort and resources have been devoted to develop solutions that address the deficiencies of both early ribbon-forming ferromagnetic glasses, as well as those of the latter bulk ferromagnetic glasses. Specifically, using a systematic micro-alloying approach, bulk ferromagnetic alloys capable of forming glasses up to 6 mm in thickness while exhibiting fracture toughness values at least twice as high as those of the early bulk glasses, approaching toughness values characteristic of conventional titanium alloys, were developed. (See, M. D. Demetriou & W. L. Johnson, United States Patent Application 20100300148; and M. D. Demetriou, et al., Appl. Phys. Lett. 95, 041907 (2009), the disclosures of which are incorporated herein by reference). The discovery of tough bulk ferromagnetic glasses constitutes a promising development that can lead to efficient and cost competitive fabrication of ferromagnetic cores with superior soft magnetic performance and adequate mechanical performance for power electronics applications, if the magnetic properties of these alloys can be improved upon.

Accordingly, a need exists for Fe-based alloys with particularly low shear moduli (below 60 GPa) that demonstrate high toughness (notch toughness in excess of 50 MPa $m^{1/2}$) yet adequate glass forming ability (critical rod diameters as large as 6 mm), and improved magnetic properties.

BRIEF SUMMARY OF THE INVENTION

Thus, there is provided in accordance with the current invention an iron-based bulk metallic glass alloy capable of having the highest possible toughness at the largest attainable critical rod diameter of the alloy.

In one embodiment, the composition of the invention includes at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5.

In another embodiment, the composition includes an atomic percent of P of from 10 to 13.

In still another embodiment, the composition includes an atomic percent of C of from 4.5 to 5.5.

In yet another embodiment, the composition includes an atomic percent of B of from 2 to 3.

In still yet another embodiment, the composition includes a combined atomic percent of P, C, and B of from 19 to 21.

In still yet another embodiment, the composition includes Si in an atomic percent of from 0.5 to 2.5. In another such embodiment, the atomic percent of Si is from 1 to 2.

In still yet another embodiment, the composition has a combined atomic percent of P, C, B, and Si of from 19 to 21.

In still yet another embodiment, the composition further comprises Mo in an atomic percent of from 2 to 8. In another such embodiment, the atomic percent of Mo is from 4 to 6. In one such embodiment, the composition further comprises Ni in an atomic percent of from 3 to 7. In still another such embodiment, the atomic percent of Ni is from 4 to 6. In yet another such embodiment, the composition further comprises Cr in an atomic percent of from 1 to 7. In still yet another such embodiment, the composition further comprises Cr in an atomic percent of from 1 to 3. In still yet another such embodiment, the composition further comprises at least one of Co, Ru, Ga, Al, and Sb in an atomic percent of from 1 to 5.

In still yet another embodiment, the composition further comprises at least one trace element wherein the total weight fraction of said at least one trace element is less than 0.02.

In still yet another embodiment, the alloy has a glass transition temperature ($T_g$) of less than 440° C.

In still yet another embodiment, the alloy has a shear modulus (G) of less than 60 GPa.

In still yet another embodiment, the alloy has a critical rod diameter of at least 2 mm.

In still yet another embodiment, the alloy has a composition in accordance with one of the following: $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, where numbers denote atomic percent.

In another embodiment, the invention is directed to a method of manufacturing a bulk metallic glass composition as set forth herein.

In still another embodiment, the invention is directed to a metallic glass object having a thickness of at least one millimeter in its smallest dimension formed of an amorphous alloy having composition as set forth herein.

In yet another embodiment, the invention is directed to a ferromagnetic Fe-based metallic glass composition that includes at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5, and that further includes at least Mo and Ni, and optionally Co and Si, and wherein the concentrations of Mo and Ni vary in accordance with the concentration of Co and Si as follows:

where Si comprises an atomic percent of from 0 to 0.5 and Co comprises an atomic percent of from 0 to 6, then Mo comprises an atomic percent of from 4.5 to 5.5, and Ni comprises an atomic percent in accordance with the equation:

$m-k\cdot z$, where m is a constant ranging from 4 to 6, k is a constant ranging from 0.5 to 1, and z represents the atomic percent of Co, and where Si comprises an atomic percent of from 0.5 to 1.5 and Co comprises an atomic percent of from 0 to 6, then Mo comprises an atomic percent of from 3.5 to 4.5 and Ni comprises an atomic percent of from 2.5 to 4.5.

In one embodiment, the atomic percent of P is from 10 to 13. In another such embodiment, the atomic percent of P is about 12.5.

In another embodiment, the atomic percent of C is from 4.5 to 5.5. In another such embodiment, the atomic percent of C is about 5.

In still another embodiment, the atomic percent of B is from 2 to 3. In another such embodiment, the atomic percent of B is about 2.5

In yet another embodiment, where Si comprises an atomic percent of from 0 to 0.5 and Co comprises an atomic percent of from 0 to 5, then Mo comprises an atomic percent of about 5 and Ni comprises an atomic percent ranging from about 2 to about 5.

In still yet another embodiment, where Si comprises an atomic percent of from 0.5 to 1.5 and Co comprises an atomic percent of from 0 to 5, then Mo comprises an atomic percent of about 4 and Ni comprises an atomic percent of about 3.

In still yet another embodiment, the alloy has a magnetization ($M_s$) of at least 1.0 T.

In still yet another embodiment, the alloy has a coercivity ($H_c$) of less than 210 A/m, when measured on a disk sample 3 mm diameter and 1 mm in height using a vibrating sample magnetometer.

In still yet another embodiment, the alloy has a retentivity ($M_r$) of less than $110\times10^{-5}$ T, when measured on a disk sample 3 mm diameter and 1 mm in height using a vibrating sample magnetometer.

In still yet another embodiment, the composition further comprises Ru in an atomic percent of from 1 to 5.

In still yet another embodiment, the composition includes at least one trace element wherein the total weight fraction of said at least one trace element is less than 0.02.

In still yet another embodiment, the alloy has a glass transition temperature ($T_g$) of less than 440° C.

In still yet another embodiment, the alloy has a shear modulus (G) of less than 60 GPa.

In still yet another embodiment, the alloy has a critical rod diameter of at least 3 mm.

In still yet another embodiment, the composition is selected from the group consisting of $Fe_{70}Ni_5Mo_5P_{12.5}C_5B_{2.5}$, $Fe_{69}Ni_4Co_2Mo_5P_{12.5}C_5B_{2.5}$, $Fe_{70}Ni_3Co_2Mo_5P_{12.5}C_5B_{2.5}$, $Fe_{69}Ni_3Co_3Mo_5P_{12.5}C_5B_{2.5}$, $Fe_{68.5}Ni_{2.5}Co_4Mo_5P_{12.5}C_5B_{2.5}$, $Fe_{68}Ni_2Co_5Mo_5P_{12.5}C_5B_{2.5}$, $Fe_{72}Ni_4Mo_4P_{11.5}C_5B_{2.5}Si_1$, $Fe_{73}Ni_3Mo_4P_{11.5}C_5B_{2.5}Si_1$, $Fe_{71}Ni_3Co_2Mo_4P_{11.5}C_5B_{2.5}Si_1$, $Fe_{70}Ni_3Co_3Mo_4P_{11.5}C_5B_{2.5}Si_1$, $Fe_{69}Ni_3Co_4Mo_4P_{11.5}C_5B_{2.5}Si_1$, and $Fe_{68}Ni_3Co_5Mo_4P_{11.5}C_5B_{2.5}Si_1$ where numbers denote atomic percent.

In still yet another embodiment, the invention is directed to a method of manufacturing a metallic glass composition including:

providing a feedstock material comprising at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5;

further comprising at least Mo and Ni, and optionally Co and Si; and wherein the concentrations of Mo and Ni vary in accordance with the concentration of Co and Si as follows:

where Si comprises an atomic percent of from 0 to 0.5 and Co comprises an atomic percent of from 0 to 6, then Mo comprises an atomic percent of from 4.5 to 5.5, and Ni comprises an atomic percent in accordance with the equation:

$m-k\cdot z$, where m is a constant ranging from 4 to 6, k is a constant ranging from 0.5 to 1, and z represents the atomic percent of Co, and where Si comprises an atomic percent of from 0.5 to 1.5 and Co comprises an atomic percent of from 0 to 6, then Mo comprises an atomic percent of from 3.5 to 4.5 and Ni comprises an atomic percent of from 2.5 to 4.5; and melting said feedstock into a molten state; and quenching said molten feedstock at a cooling rate sufficiently rapid to prevent crystallization of said alloy.

In one embodiment, the method further includes annealing the metallic glass after quenching.

In still yet another embodiment, the invention is directed to a magnetic metallic glass object including:

a body formed of a metallic glass alloy comprising at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5;

further comprising at least Mo and Ni, and optionally Co and Si; and wherein the concentrations of Mo and Ni vary in accordance with the concentration of Co and Si as follows:

where Si comprises an atomic percent of from 0 to 0.5 and Co comprises an atomic percent of from 0 to 6, then Mo comprises an atomic percent of from 4.5 to 5.5, and Ni comprises an atomic percent in accordance with the equation:

$m-k\cdot z$, where m is a constant ranging from 4 to 6, k is a constant ranging from 0.5 to 1, and z represents the atomic percent of Co, and where Si comprises an atomic percent of from 0.5 to 1.5 and Co comprises an atomic percent of from 0 to 6, then Mo comprises an atomic percent of from 3.5 to 4.5 and Ni comprises an atomic percent of from 2.5 to 4.5.

In one embodiment, the object is a magnetic core used in the generation or conversion of electrical power.

In another embodiment, the magnetic core has a planar shape, a torroidal shape, a ring shape, a U shape, a C shape, an I shape, an E shape, or any combination of the above shapes.

In still another embodiment, the magnetic core is an assembly of more than one component, and wherein each component has a cross section thickness of not less than 0.5 mm.

In yet another embodiment, the magnetic core is monolithic.

In still yet another embodiment, the magnetic object is selected from the group consisting of inductors, transformers, clutches, and DC/AC converters.

BRIEF DESCRIPTION OF THE DRAWINGS

The description will be more fully understood with reference to the following figures and data charts, which are presented as exemplary embodiments of the invention and should not be construed as a complete recitation of the scope of the invention, wherein.

DETAILED DESCRIPTION OF THE INVENTION

Figure 1:
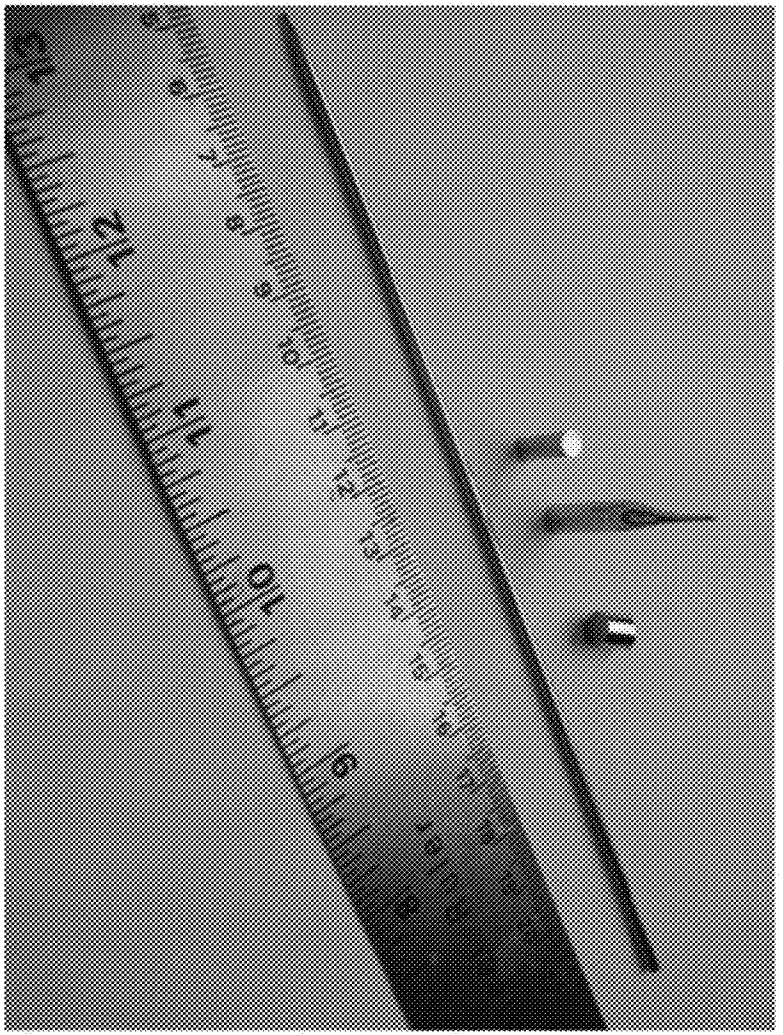
FIG. 1 presents amorphous rods of various diameters made from Fe-based alloys of the present invention.

The current invention is directed to an iron-based metallic glass having excellent processability and toughness such that it can be used for novel structural applications. Specifically, the inventive iron-based alloy is based on the observation that by very tightly controlling the composition of the metalloid moiety of the Fe-based, P-containing bulk metallic glass alloys it is possible to obtain highly processable alloys with surprisingly low shear modulus and high toughness. Still more specifically, the Fe alloys of this invention are able to form glassy rods with diameters up to 6 mm, have a shear modulus of 60 GPa or less, and notch toughness of 40 MPa $m^{1/2}$ or more.

DEFINITIONS

Metallic Glasses: For the purposes of this invention refer to a class of metal alloys which exhibit high strength, large elastic strain limit, and high corrosion resistance owing to their amorphous nature. They are isotropic, homogeneous, and substantially free from crystalline defects. (Exemplary BMGs may be found in U.S. Pat. Nos. 5,288,344; 5,368,659; 5,618,359; and 5,735,975, the disclosure of each of which are incorporated herein by reference.)

DESCRIPTION

The link between high shear modulus and the low toughness of traditional Fe-based glasses rests on the understanding that a high shear modulus designates a high resistance to accommodate stress by undergoing shear flow, which promotes cavitation and early fracture and thus limits toughness. (See, Demetriou et al., Appl Phys Lett 2009:95; 195501, the disclosure of which is incorporated herein by reference). Aside from their high G, the brittle behavior of these glasses can also be predicted by their high $T_g$, which for some Fe-based glasses was reported to be in excess of 600° C. (See, e.g., Lu Z P, et al., Phys Rev Lett 2004 & Ponnambalam V, et al. J Mater Res 2004, cited above). The glass transition temperature is also a measure of the resistance to accommodate stress by undergoing shear flow. (See, Demetriou et al., Appl. Phys Lett 2009:95; 195501, the disclosure of which is incorporated herein by reference). Such high G and $T_g$ therefore designate a high barrier for shear flow, which explains the poor toughness of these glasses.

The family of the Fe—P—C glass-forming alloy system was first introduced by Duwez and Lin in 1967, who reported formation of glassy foils 50-mm in thickness. (See, e.g., Duwez P & Lin S C H., J Appl Phys 1967:38; 4096, the disclosure of which is incorporated herein by reference). Subsequent investigations revealed that glassy Fe—P—C microwires exhibit a rather high tensile and bending ductility. (See, e.g., Inoue A, et al., J Mater Sci 1982:17; 580; and Masumoto T & Kimura H., Sci Rep Res Inst Tohoku Univ 1975:A25; 200, the disclosure of which is incorporated herein by reference). The ductility can be associated with a relatively low $T_g$, reported to be just over 400° C., and with a relatively low G. (See, Duwez P & Lin S C H., J Appl Phys 1967, cited above). Using the reported uniaxial yield strength of Fe—P—C of ~3000 MPa and the universal shear elastic limit for metallic glasses of 0.0267, a shear modulus of ~56 GPa can be expected. (See, e.g., Johnson W L & Samwer K. Phys Rev Lett 2005; and Masumoto T & Kimura H. Sci Rep Res Inst Tohoku Univ 1975, cited above). Owing to such low G and $T_g$, one would expect the Fe—P—C glass to also exhibit high toughness. The plane-stress fracture toughness of glassy Fe—P—C ribbons was measured by Kimura and Masumoto to be 32 MPa $m^{1/2}$, a value substantially higher than many of the bulk glasses of the prior art. (See, e.g., Kimura H &

Masumoto T. Scripta Metall 1975:9; 211, the disclosures of each of which are incorporated herein by reference).

In 1999 Shen and Schwarz reported development of bulk glassy alloys derived from the Fe—P—C system. (See, e.g., Shen T D & Schwarz R B., Appl Phys Lett 1999:75; 49, the disclosure of which is incorporated herein by reference). Specifically, they demonstrated that by substituting a fraction of C with B and fractions of Fe with Co, Cr, Mo, and Ga in a base Fe—P—C composition, glassy rods with diameters up to 4 mm could be formed. More recently, the alloy systems of (Fe,Mo)—P—(C,B), (Fe,Mo)—(P,Si)—(C,B), (Fe,Cr,Mo)—P—(C,B), (Fe,Ni,Mo)—P—(C,B), and (Fe,Co,Mo)—(P,Si)—(C,B) have been explored, all of which were found to form bulk glasses with critical rod diameters ranging from 2 to 6 mm. (See, e.g., Gu X J, et al., Acta Mater 2008:56; 88; Zhang T, et al., Mater Trans 2007:48; 1157; Shen B, et al., Appl Phys Lett 2006:88; 131907; Liu F, et al., Mater Trans 2008:49; 231; and Li F, et al., Appl Phys Lett 2007:91; 234101, the disclosures of each of which are incorporated herein by reference). However, the glass-transition temperatures and shear moduli of these alloys are not low. In particular, $T_g$ values as high as 470° C. and G values of nearly 70 GPa have been reported for those systems. Consequently those glasses do not demonstrate an optimum glass-forming-ability/toughness relation, that is, they do not exhibit the highest possible toughness at the largest attainable critical rod diameter.

In the instant invention it has been surprisingly discovered that by tailoring the metalloid moiety of these alloys it is possible to obtain a family of Fe-based, P-containing bulk-glass forming compositions with $T_g$ values below 440° C. and having values of G of less than 60 GPa that can be cast into rods of at least 2 mm or more, such that an optimum glass-forming ability-toughness relationship is attained.

Accordingly, in one embodiment, the composition of the alloys in accordance with the current invention may be represented by the following formula (subscripts denote atomic percent):

$$[Fe,X]_a[(P,C,B,Z)]_{100-a} \quad \text{(EQ. 1)}$$

where:

a is between 79 and 81, and preferably, a is 80;

The atomic percent of P is between 5 and 17.5, and preferably between 11 and 12.5; the atomic percent of C is between 3 and 6.5, and preferably 5; the atomic percent of B is between 1 and 3.5, and preferably 2.5.

X is an optional metal or a combination of metals selected from Mo, Ni, Co, Cr, Ru, Al, and Ga; preferably, X is a combination of Mo, Ni, and Cr, where the atomic percent of Mo is between 2 and 8, and preferably 5, the atomic percent of Ni is between 3 and 7, and preferably 5, and the atomic percent of Cr is between 1 and 3, and preferably 2.

Z is an optional metalloid selected from Si and Sb, where the atomic percent of Z is between 0.5 and 2.5, and preferably 1.5.

Other trace elements can be added in the proposed composition formula having a total weight fraction of less than 0.02.

Using the above formulation, and particularly the novel metalloid moiety, it has been surprisingly discovered that it is possible to obtain bulk metallic glass alloys having excellent toughness, $T_g$ values below 440° C. and G of less than 60 GPa, that may be cast in amorphous rods with a critical rod diameter of 3 mm or more, and in some instances 6 mm.

Although the above composition represents one formulation of the family of iron-based phosphor containing bulk metallic glasses in accordance with the instant invention, it should be understood that alternative compositional formulations are contemplated by the instant invention.

First, because the interstitial metalloids like B and C increase glass forming ability, but also increase the shear modulus such that they degrade toughness. The effect of B and C on increasing shear modulus and degrading toughness is also known to occur in conventional (crystalline) steel alloys. In the present invention, it has been discovered that by tightly controlling the fraction of these metalloids it is possible to obtain an optimal balance between glass formation and toughness. In one such embodiment, the alloys of the instant invention include a metalloid moiety comprising of P, C, B and optionally Z, where Z can be one or both of Si and Sb, wherein the combined atomic percent (P+C+B+Z) is from 19 to 21. In such an embodiment, the atomic percent of C is from 3 to 6.5, and preferably from 4 to 6; the atomic percent of B is from 1 to 3.5, and preferably from 2 to 3; and the atomic percent of Z is from 0.5 to 2.5, and preferably from 1 to 2.

In another alternative embodiment, some portion of the Fe content can be substituted with a combination of other metals. In such an embodiment, Fe, in a concentration of more than 60 atomic percent, and preferably from 68 to 75, is substituted with Mo in a concentration of from 2 to 8, and preferably 5 atomic percent. In such a Mo-substituted alloy, the Fe may be further replaced by from 3 to 7 atomic percent, and preferably 5 atomic percent, Ni. In such a Mo and Ni-substituted alloy, the Fe may be further substituted by from 1 to 3, and preferably 2 atomic percent Cr.

Alternatively, Fe may be substituted by between 1 to 5 atomic percent of at least one of Co, Ru, Al and Ga.

Generally speaking, up to 4 atomic percent of other transition metals is acceptable in the glass alloy. It can also be noted that the glass forming alloy can tolerate appreciable amounts of several elements that could be considered incidental or contaminant materials. For example, an appreciable amount of oxygen may dissolve in the metallic glass without significantly shifting the crystallization curve. Other incidental elements such as germanium or nitrogen may be present in total amounts less than about two atomic percent, and preferably in total amounts less than about one atomic percent.

Although the above discussion has focused on the composition of the alloy itself, it should be understood that the invention is also directed to methods of forming Fe-based, P-containing bulk metallic glasses in accordance with the above formulations, and in forming articles from the inventive alloy compositions. In one such embodiment, a preferred method for producing the alloys of the present invention involves inductive melting of the appropriate amounts of constituents in a quartz tube under inert atmosphere. A preferred method for producing glassy rods from the alloys of the present invention involves re-melting the alloy ingots inside quartz tubes of 0.5-mm thick walls under inert atmosphere and rapidly water quenching. Alternatively, glassy rods can be produced from the alloys of the present invention by re-melting the alloy ingots inside quartz tubes of 0.5-mm thick walls under inert atmosphere, bringing the molten ingots in contact with molten boron oxide for about 1000 seconds, and subsequently rapidly water quenching. Amorphous Fe-based rods of various diameters made from alloys of the present invention are presented in FIG. 1.

It should be understood that the above alternative embodiments are not meant to be exclusive, and that other modifications to the basic apparatus and method that do not render the composition unprocessible (critical rod thickness of less than 1 mm), or insufficiently tough (shear modulus values of greater than 60 GPa) for structural applications can be used in conjunction with this invention.

EXEMPLARY EMBODIMENTS

The person skilled in the art will recognize that additional embodiments according to the invention are contemplated as being within the scope of the foregoing generic disclosure, and no disclaimer is in any way intended by the foregoing, non-limiting examples.

EXPERIMENTAL METHODS & MATERIALS

Alloy ingots were prepared by induction melting mixtures of the appropriate amounts of Fe (99.95%), Mo (99.95%), Ni (99.995%), Cr (99.99%), B crystal (99.5%), graphite powder (99.9995%), and P (99.9999%) in quartz tubes sealed under high-purity argon atmosphere. A 50-mm thick glassy $Fe_{80}P_{12.5}C_{7.5}$ foil was prepared using an Edmund Buhler D-7400 splat quencher. All other alloys were formed into glassy cylindrical rods by re-melting the alloy ingots in quartz tubes of 0.5-mm thick walls under high-purity argon atmosphere and rapidly water quenching. X-ray diffraction with Cu-Ka radiation was performed to verify the amorphous nature of the glassy foils and rods. Differential scanning calorimetry at a scan rate of 20 K/min was performed to determine the transition temperatures for each alloy.

The elastic constants of alloys in the present invention capable of forming amorphous rods with diameters greater than 2 mm were evaluated using ultrasonic measurements along with density measurements. Shear and longitudinal wave speeds of glassy $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ rods were measured by pulse-echo overlap using 25 MHz piezoelectric transducers. Densities were measured by the Archimedes method, as given in the American Society for Testing and Materials standard C693-93.

Notch toughness tests for alloys in the present invention capable of forming amorphous rods with diameters greater than 2 mm were performed. For the toughness tests, 2-mm diameter glassy rods of $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ were utilized. The rods were prepared by re-melting alloy ingots in 2-mm ID quartz tubes of 0.5 mm thick walls under high-purity argon atmosphere and rapidly water quenching. The rods were notched using a wire saw with a root radius of 90 mm to a depth of approximately half the rod diameter. The notched specimens were placed on a 3-pt bending fixture with span distance of 12.7 mm and carefully aligned with the notched side facing downward. The critical fracture load was measured by applying a monotonically increasing load at constant cross-head speed of 0.1 mm/min using a screw-driven Instron testing frame. At least three tests were performed for each alloy. The specimen fracture surfaces were examined by scanning electron microscopy using a LEO 1550VP Field Emission SEM.

The stress intensity factor for the cylindrical configuration employed was evaluated using the analysis of Murakimi. (See, e.g., Murakami Y., Stress Intensity Factors Handbook. Vol. 2. Oxford (United Kingdom): Pergamon Press; 1987. p. 666, the disclosure of which is incorporated herein by reference). The dimensions of the specimens are large enough to satisfy the standard size requirement for an acceptable plane-strain fracture toughness measurement, $K_{IC}$. Specifically, considering that the most frequent ligament size in the present specimens was ~1 mm, and taking the yield strength for this family of glasses to be ~3200 MPa, nominally plane strain conditions can be assumed for fracture toughness measurements of $K_{IC}$<60 MPa $m^{1/2}$, as obtained here. (See, e.g., Gu X J, et al., Acta Mater 2008; Zhang T, et al., Mater Trans 2007; Shen B, et al., Appl Phys Lett 2006; Liu F, et al., Mater Trans 2008; and Li F, et al., Appl Phys Lett 2007, cited above). Nevertheless, since sharp pre-cracks ahead of the notches were not introduced in the present specimens (as required for standard $K_{IC}$ evaluation), the measured stress intensity factors do not represent standard $K_{IC}$ values. In this sense, direct comparison of the notch toughness, $K_Q$, evaluated in this study with standard $K_{IC}$ values for conventional metals is inappropriate. Nonetheless, $K_Q$ values provide useful information about the variation of the resistance to fracture within a set of uniformly-tested materials. Due to inherent critical-casting-thickness limitations of many newly-developed metallic glass alloys, notch toughness measurements using specimens with cylindrical geometry and no preexisting cracks are often reported for metallic-glass alloy systems. (See, e.g., Wesseling P, et al., Scripta Mater 2004:51; 151; and Xi X K, et al., Phys Rev Lett 2005:94; 125510, the disclosures of which are incorporated herein by reference). More specifically, the notch toughness measurements performed recently for Fe-based bulk metallic glasses by Lewandowski et al. using specimens with configurations and dimensions similar to the present study are suitable for direct comparison with the present estimates. (See, e.g., Nouri A S, et al., Phil. Mag. Lett. 2008:88; 853, the disclosure of which is incorporated herein by reference.)

Example 1

Compositional Survey

Figure 2:
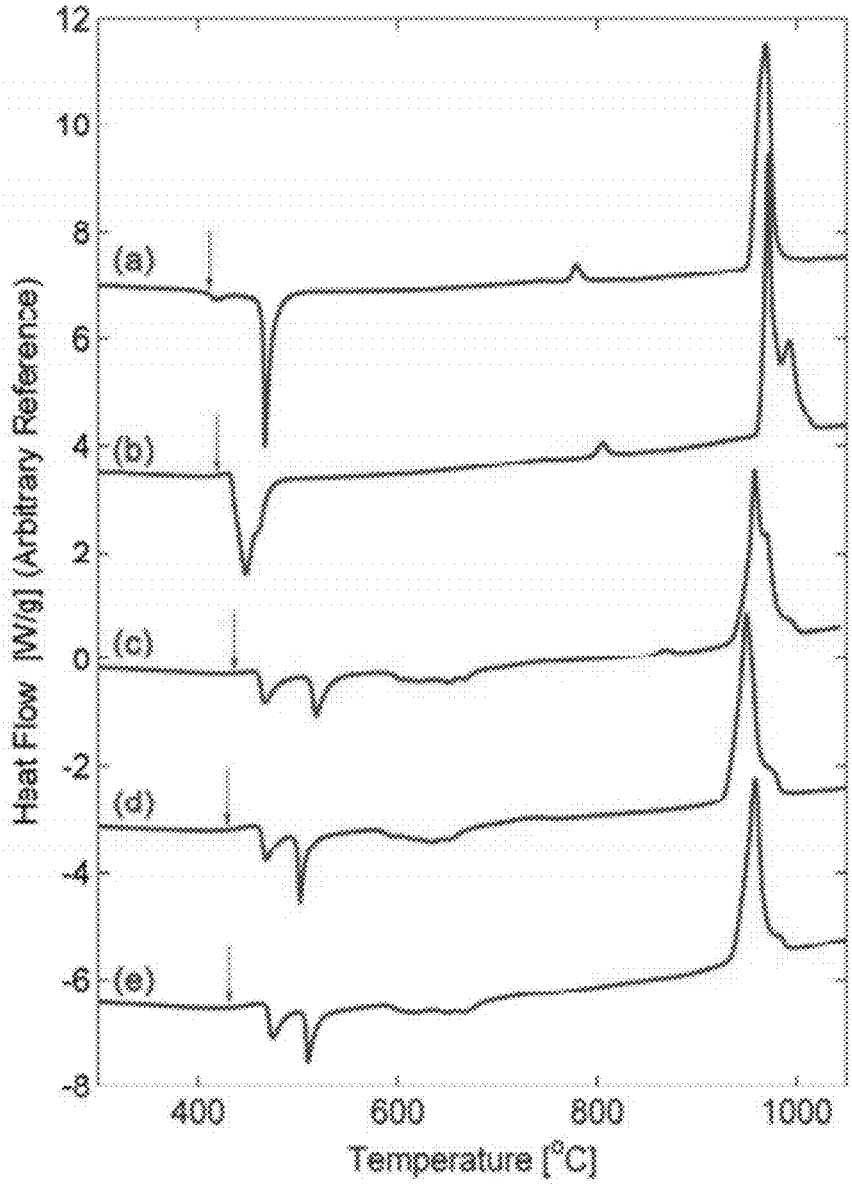
FIG. 2 provides data graphs for differential scanning calorimetry measurements conducted at 20 K/min scan rate for amorphous samples of (a) $Fe_{80}P_{12.5}C_{7.5}$ (b) $Fe_{80}P_{12.5}(C_5B_{2.5})$, (c) $(Fe_{74.5}Mo_{5.5})P_{12.5}(C_5B_{2.5})$, (d) $(Fe_{70}Mo_5Ni_5)P_{12.5}(C_5B_{2.5})$, and (e) $(Fe_{68}Mo_5Ni_5Cr_2)P_{12.5}(C_5B_{2.5})$, where the arrows designate the glass transition temperatures of each of the alloys.

Alloys developed based on this compositional survey along with the associated critical rod diameters are listed in Table 1, below. Thermal scans are presented in FIG. 2, and $T_g$ for each alloy is listed in Table 1. The measured shear and bulk moduli along with the molar volumes of $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ are also listed in Table 1. As seen in Table 1, the exemplary Fe-based alloys are capable of forming glassy rods with diameters ranging from 0.5 mm to 6 mm, and exhibit shear moduli of less than 60 GPa, in accordance with the criteria set forth in this invention.

TABLE 1

Compositional Survey

| Composition | $T_g$ [° C.] | $d_c$ [mm] | $v_m$ [$m^3$/mol] | G [GPa] | B [GPa] | $K_Q$ [MPa $m^{1/2}$] |
|---|---|---|---|---|---|---|
| $Fe_{80}P_{12.5}C_{7.5}$ (prior art alloy) | 405 | 0.05* | — | 56† | — | 32‡ |
| $Fe_{80}P_{12.5}(C_5B_{2.5})$ | 412 | 0.5 | — | — | — | — |
| $(Fe_{74.5}Mo_{5.5})P_{12.5}(C_5B_{2.5})$ | 429 | 3 | $6.85 \times 10^{-6}$ | 56.94 ± 0.09 | 145.0 ± 0.3 | 53.1 ± 2.4 |

TABLE 1-continued

| Compositional Survey | | | | | | |
|---|---|---|---|---|---|---|
| Composition | $T_g$ [° C.] | $d_c$ [mm] | $v_m$ [$m^3$/mol] | G [GPa] | B [GPa] | $K_Q$ [MPa $m^{1/2}$] |
| $(Fe_{70}Mo_5Ni_5)P_{12.5}(C_5B_{2.5})$ | 423 | 4 | $6.89 \times 10^{-6}$ | 57.31 ± 0.08 | 150.1 ± 0.4 | 49.8 ± 4.2 |
| $(Fe_{68}Mo_5Ni_5Cr_2)P_{12.5}(C_5B_{2.5})$ | 426 | 6 | $6.87 \times 10^{-6}$ | 57.94 ± 0.07 | 149.7 ± 0.3 | 44.2 ± 4.6 |

*Critical foil thickness attainable by splat quenching or melt spinning. (See, Duwez P & Lin SCH. J Appl Phys 1967, cited above.)
†Estimated using the reported uniaxial yield strength of ~3000 MPa and the universal shear elastic limit of 0.0267. (See, Johnson WL & Samwer K. Phys Rev Lett 2005; and Masumoto T & Kimura H. Sci Rep Res Inst Tohoku Univ 1975, cited above.)
‡Plane-stress fracture toughness measured by "trouser-leg" type shear tests. (See, Kimura H, Masumoto T. Scripta Metall 1975, cited above.)

It is interesting to note that substitution of 1.5% P by Si in the inventive compositions listed in Table 1, above, was found to slightly improve glass-forming ability. The Si-containing versions of the above compositions are $Fe_{80}(P_{11}Si_{1.5})(C_5B_{2.5})$, $(Fe_{74.5}Mo_{5.5})(P_{11}Si_{1.5})(C_5B_{2.5})$, $(Fe_{70}Mo_5Ni_5)(P_{11}Si_{1.5})(C_5B_{2.5})$, and $(Fe_{68}Mo_5Ni_5Cr_2)(P_{11}Si_{1.5})(C_5B_{2.5})$.

Figure 3:
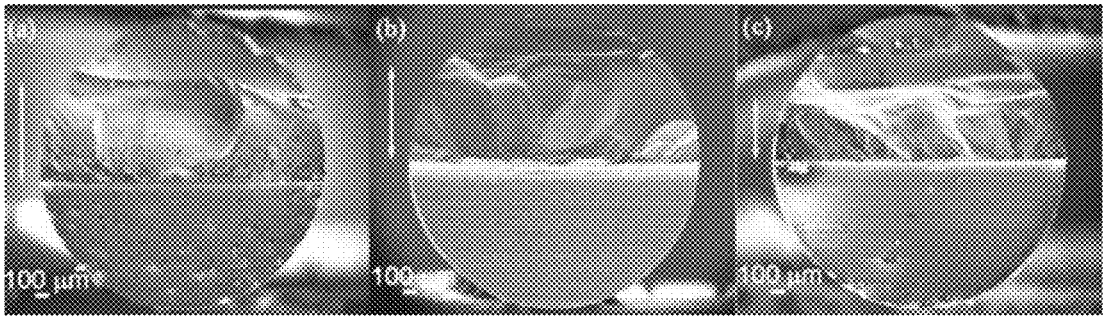
FIG. 3 provides scanning electron micrographs of the fracture surfaces of amorphous specimens of composition (a) $(Fe_{74.5}Mo_{5.5})P_{12.5}(C_5B_{2.5})$, (b) $(Fe_{70}Mo_5Ni_5)P_{12.5}(C_5B_{2.5})$, and (c) $(Fe_{68}Mo_5Ni_5Cr_2)P_{12.5}(C_5B_{2.5})$, where the arrows designate the approximate width of the "jagged" region that develops adjacent to the notch of each specimen.

The measured notch toughness $K_Q$ of $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ along with quoted errors representing standard deviations in values are presented in Table 1. Despite the relatively large uncertainty ranges, which can be attributed to processing defects that often exceed the relatively small plastic zone size of these glasses, the data reveal a monotonically decreasing trend in $K_Q$ in going from the most modest to the best glass former. (See, e.g., Nouri A S, et al., Phil. Mag. Lett. 2008:88; 853, the disclosure of which is incorporated herein by reference). This trend is also reflected by the fracture-surface morphologies of the tested specimens shown in the micrographs of FIG. 3. The fracture surfaces of these alloys reveal rough "jagged" patterns at the beginning stage of crack propagation, followed by the characteristic dimple pattern typical of brittle glassy metal fracture. (See, e.g., Suh JY. PhD Dissertation, California Institute of Technology 2009, the disclosure of which is incorporated herein by reference). The extent of such jagged regions ahead of the typical dimple morphology suggests that substantial plastic flow occurred prior to catastrophic fracture, which supports the relatively high $K_Q$ values. More interestingly, the width of these jagged regions (approximated by arrows in FIG. 3) decreases on going from tougher to more brittle alloys, suggesting that the width of the jagged region roughly scales with $K_Q$, or more appropriately, with the characteristic plastic zone size of the material. The existence of such a scaling relation has also been noted by Suh (cited above).

Example 2

Toughness—Glass-Forming Ability Relation for the Inventive Alloys

Figure 4:
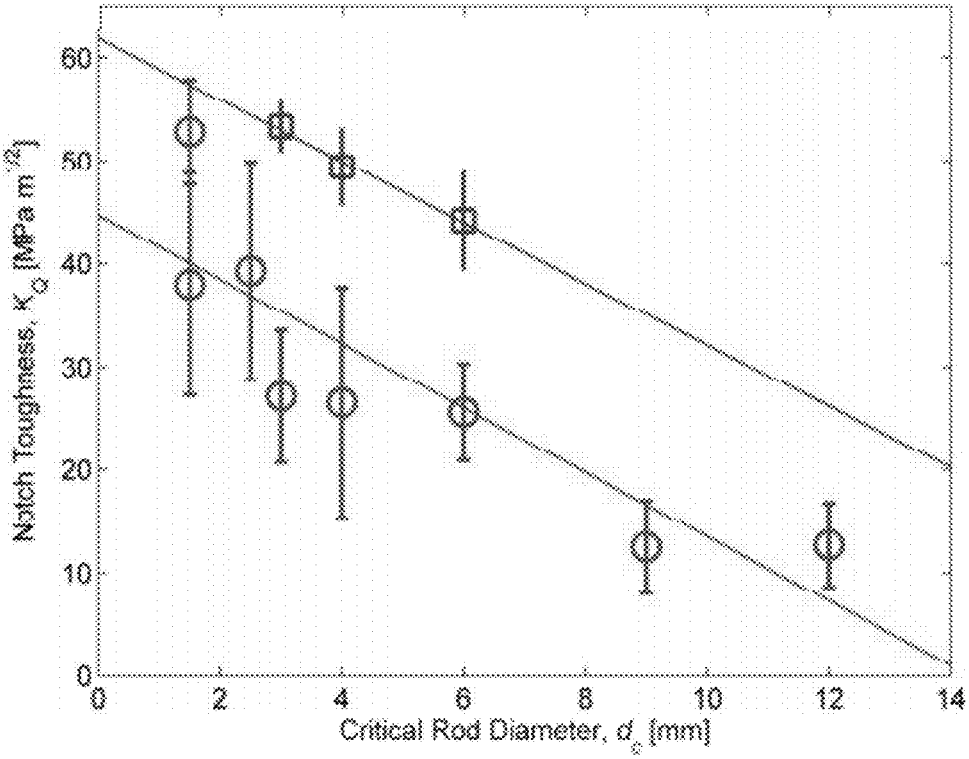
FIG. 4 provides a data graph plotting notch toughness vs. critical rod diameter for amorphous $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ (□), and for the Fe-based glasses developed by Poon and co-workers [Ponnambalam V, et al., J Mater Res 2004:19; 1320; Gu X J, et al., J Mater Res. 2007:22; 344; Gu X J, et al., Acta Mater 2008:56; 88; and Gu X J, et al., Scripta Mater 2007:57; 289, the disclosure of which are incorporated herein by reference] and investigated by Lewandowski and co-workers [Lewandowski J J, et al., Appl Phys Lett 2008:92; 091918; and Nouri A S, et al., Phil. Mag. Lett. 2008:88; 853, the disclosures of which are incorporated herein by reference] (○), where the lines are linear regressions to the data.

In FIG. 4 the trend of decreasing toughness with increasing glass-forming ability is exemplified by plotting the notch toughness $K_Q$ against the critical rod diameter $d_c$ for $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$. Interestingly, the plot reveals that this trend is roughly linear. On the same plot we also present $K_Q$ vs. $d_c$ data for the Fe-based glassy alloys developed by Poon and co-workers (cited above), and investigated by Lewandowski and co-workers (cited above). A linear regression through the data reveals a toughness vs. glass-forming ability correlation of similar slope but lying well below the correlation demonstrated by the present data.

Figure 5:
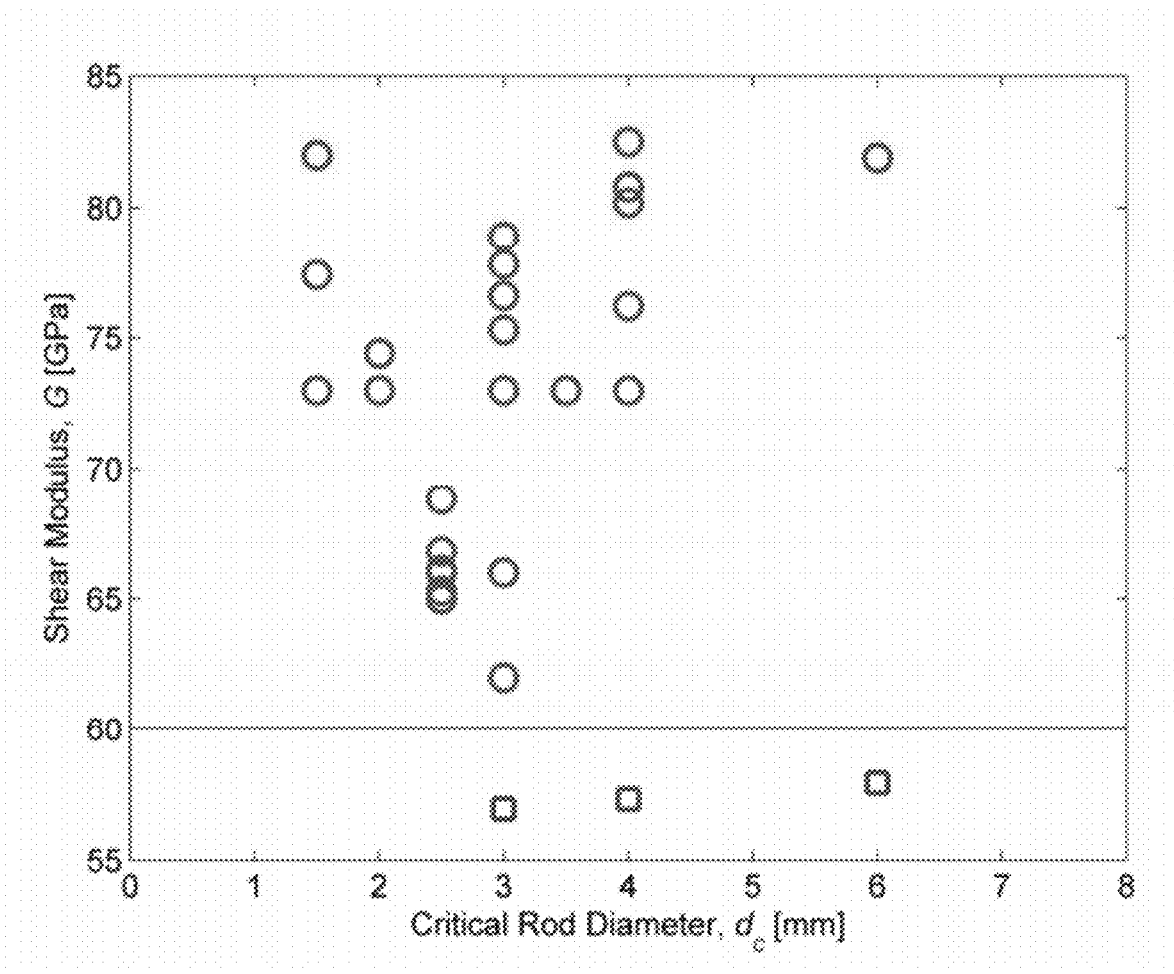
FIG. 5 provides a data graph plotting shear modulus vs. critical rod diameter for amorphous $(Fe_{74.5}Mo_{5.5})(P_{12.5}C_5B_{2.5})$, $(Fe_{70}Mo_5Ni_5)(P_{12.5}C_5B_{2.5})$, and $(Fe_{68}Mo_5Ni_5Cr_2)(P_{12.5}C_5B_{2.5})$ (□), and for the Fe-based glasses developed by Poon and co-workers (cited above) (○), it should be noted that alloys of this invention exhibit shear modulus less than 60 GPa (designated by line) at critical rod diameters comparable to the alloys of the prior art.

The much higher toughness for a given critical rod diameter exhibited by the inventive alloys compared to prior art alloys is attributed to their much lower shear modulus. (See Demetriou et al. cited above). The compositional investigations that led to glass formation of the prior art alloys was performed without seeking to minimize shear modulus and hence maximize toughness. Specifically, the fractions of C and B in the prior art alloys are high such that they give rise to a high shear modulus which promotes low toughness. All alloys in the prior art capable of forming bulk glassy rods comprise materials in which at least one or both of C and B have atomic percentages greater than 6.5 and 3.5, respectively. By contrast, in the present invention the fractions of C and B were carefully controlled such that they are high enough to promote glass formation, yet low enough to enable a low shear modulus and promote a high toughness. Alloy compositions in the present invention capable of forming bulk glassy rods comprise C and B at atomic percentages not less than 3 and 1, and not more than 6.5 and 3.5, respectively. Maintaining the atomic percentages of C and B within those ranges enables bulk-glass formation while maintaining a low shear modulus, which promotes a high toughness. This is exemplified in FIG. 5, where the shear modulus of the inventive alloys as well as those of the prior art are plotted against their respective critical rod diameters. A much lower shear modulus is revealed for the inventive alloys at a given critical rod diameter, which is the origin of their much higher toughness at a given rod diameter, as revealed in FIG. 4.

Example 3

Magnetic Properties for the Inventive Alloys

In another embodiment, the magnetic properties of the alloys were explored. In particular, the current embodiment explores the optimization of the bulk ferromagnetic alloy compositions to improve the soft magnetic properties while maintaining high toughness and glass-forming ability.

Background

Both inductors and transformers are essential components in power electronics as a means for storing magnetic energy and converting from one voltage to another. Since both involve modulating the magnetization of a material through AC current, it is necessary to find a material that is easily magnetized with minimal energy loss. Amorphous metal alloys fit this requirement, and are increasingly being adopted as transformer and inductor cores.

There are a number of magnetic properties that must be taken into consideration when choosing a material for use in power electronics. First, the material's saturation magnetization ($M_s$), which determines how much the material can be magnetized, is proportional to magnetic flux density, and consequently, energy density. Thus, a higher $M_s$ can lead to smaller and lighter components, which is especially important in vehicles and avionic electronics, where weight is a major factor in fuel economy. Second, the coercivity ($H_c$), which is the applied magnetic force required to return the material's magnetization to zero, and magnetic remanence ($M_r$), which is the magnetization of a material after the external magnetic field is removed, are both proportional to the magnetic hysteresis, or its switching loss. Especially in high switching frequency applications, a low $H_c$ and $M_r$ imply low switching loss and higher energy efficiency. Low losses also lead to lower operating temperatures, which would reduce the size of heat sinks for heat dissipation of power systems, which in turn improves the overall system cost and efficiency.

While metal alloys are typically crystalline, amorphous metal alloys are devoid of any repeating atomic structure. As a result, they have a different set of properties and are a topic of high interest. Fe-based amorphous metal alloys have been a subject of great interest as soft magnetic materials for inductor and transformer cores in advanced power electronic applications. These alloys are highly desirable for their superior soft magnetic properties. High magnetization saturation leads to cores with higher power for a given size. Low coercivity, low magnetic remanence, and small hysteresis lead to low switching losses and high efficiency. However, as previously discussed these commercial amorphous metal alloys can only be formed in foil form at thicknesses of less than 100 μm, limiting their impact in industry due to the high costs associated with fabricating bulk ferromagnetic components using these foils.

Objective

Accordingly, the objective of the current embodiment is to find a bulk Fe-based amorphous alloy with good magnetic properties and glass-forming ability. Although there are a number of bulk amorphous alloys with $M_s$ of 1.1-1.3 T, many of them have a moderate GFA, forming rods of 2.5 mm or less. (See, e.g., A. Makino, et al., *Materials Transactions*, vol. 48, no. 11, October, pp. 3024-3027, (2007); and A. Inoue, et al., *Transactions on Magnetics*, vol. 32, no. 5, September, pp. 4866-4871, (1996), the disclosures of which are incorporated herein by reference). Conversely, many of the alloys that have a better GFA and form rods of over 3 mm have a $M_s$ typically below 1.1 T. (See, e.g., T. D. Shen and R. B. Schwarz, *Applied Physics Letters*, vol. 75, no. 1, July, pp. 49-50, (1999); F. Li, et al., *Applied Physics Letters*, vol. 91, no. 234101, December, (2007); and A. Inoue, et al., *Applied Physics Letters*, vol. 71, no. 4, July, pp. 464-466, (1997), the disclosures of which are incorporated herein by reference). In terms of cost, many of these alloys contain Ga, which is an expensive element and potentially toxic that may hinder the use of these alloys in commercial applications. (See, e.g., K. Amiya, et al., *Materials Science and Engineering*, vol. 449, February, pp. 356-359, 2007; and A. Inoue and J. S. Gook, *Materials Transactions*, vol. 36, no. 9, May, 1180-1183, (1995), the disclosures of which are incorporated herein by reference). Concerning switching losses, the $H_c$ for most of these alloys are below 10 A/m. Thus, the goals of this embodiment is to develop tough iron-based metallic glass compositions with high saturation magnetization, low hysteresis, and a high enough glass forming ability to enable fabrication of monolithic ferromagnetic components, all without using expensive elements such as Ga.

Magnetic measurements in the present embodiment were carried out on amorphous disks 3 mm in diameter and about 1 mm in height, with mass of approximately 0.1 g. It is noted that the disk geometry is adequate for measuring saturation magnetization, but is not ideal for measuring hysteresis properties such coercivity and magnetic remanence. This is because this geometry produces a demagnetizing effect, which results in larger-than-ideal hysteresis and higher coercivity and remanent magnetization. The ideal geometry to measure the hysteresis properties is an infinitely long and thin rod with the magnetic field applied parallel to the rod. A torroidal geometry with the magnetic field applied in the angular direction of the torroid is a good approximation to that ideal geometry, and is widely used to measure these properties. But in the present embodiment, a disk geometry is employed for its ease of fabrication, which is adequate for measuring the saturation magnetization, but sub-standard for measuring coercivity and remanent magnetization. Therefore, the present results for coercivity and remanent magnetization are not the inherent values for the alloys, but rather upper limits specific to the disk geometry implemented here. Nevertheless, the results are useful in a relative sense, to the extent that they enable a comparison between the alloys of the present invention.

To accomplish the objectives set for this invention, a systematic micro-alloying approach was implemented to improve the soft magnetic performance of the ferromagnetic bulk-glass-forming compositions with high toughness and good glass-forming ability of the current application. The earlier composition $Fe_{70}Ni_5Mo_5P_{12.5}C_5B_{2.5}$, capable of forming glassy rods up to 4 mm in diameter with a toughness of 50 MPa $m^{1/2}$, already exhibited excellent soft magnetic behavior but the saturation magnetization was fairly low. Specifically, metallic glass alloy $Fe_{70}Ni_5Mo_5P_{12.5}C_5B_{2.5}$ exhibits coercivity of 8.161 A/m and magnetic remanence of $3.9\times10^{-5}$ T, both low and characteristic of a soft magnetic behavior. The saturation magnetization of the earlier alloy is measured to be 1.02 T, and although it can be considered satisfactory for applications such as inductor cores, it is nevertheless lower than commercial Metglas™ cores with values approaching 1.6 T.

The current effort was focused primarily on incorporating Co and Si in compositional variations of the early metallic glass composition $Fe_{70}Ni_5Mo_5P_{12.5}C_5B_{2.5}$ in a manner that leads to higher saturation magnetization without substantially increasing the low coercive field and magnetic remanence of the alloy, and also without degrading its good glass forming ability and high toughness.

It has been reported that the addition of Si in Fe-based glassy alloys can improve both saturation magnetization and glass-forming ability although additions of Si may also increase coercivity. (See, e.g., R. Piccin, et al., *Journal of Magnetism and Magnetic Materials*, vol. 320, April, pp. 806-809, (2008); and F. Liu, et al., *Journal of Alloys and Compounds*, vol. 483, July, pp. 613-615, (2009), the disclosures of which are incorporated herein by reference). In order to have a high GFA, amorphous alloys require atoms of different sizes (at least 10% difference) in order to promote the so-called "confusion effect" on the atomic structure. Because $Fe_{70}Ni_5Mo_5P_{12.5}C_5B_{2.5}$ already has a reasonable GFA, it was thought that it would be best to substitute elements having similar atomic radii in order not to disrupt the "confusion" order and maintain GFA when adding in new elements. Thus, Si was added into the composition in place of P, its neighbor on the periodic table. It has been reported that replacing P by Si will raise M, while replacing Fe by Si will actually decrease M, most likely due to the fact that Fe is ferromagnetic. (See, K. Amiya, et al., *Materials Science and Engineering*, (2007), cited above). It has also been reported that small amounts of Co (up to approximately 20% of the amount of Fe) can improve GFA and $M_s$ while lowering $H_c$ and hysteresis losses. (See, e.g., R. Piccin, et al., *Journal of Magnetism and Magnetic Materials*, (2008), cited above). Accordingly, Co is added into the composition substituting its neighbors on the periodic table, Fe and Ni. Nevertheless, as will be shown below, if direct substitutions of P by Si, or Fe by Co, were to be attempted without further compositional rearrangements, the glass forming ability will decrease substantially. Specifically, it was discovered that substitution of P by Si should be accompanied by substitution of some Ni and Mo by Fe in order to maintain glass forming ability. Furthermore, introduction of Co should be accommodated by a reduction in both Ni and Fe, but the reduction in Ni should be greater than in Fe in order to maintain glass forming ability. Lastly, it was discovered that the Si-containing compositions require fluxing, preferably with boron oxide, in order to maintain glass forming ability.

As described below, in the current embodiment introduction of Co and Si is shown to increase the saturation magnetization in ferromagnetic glasses. Furthermore, introduction of Si also enables glass formation with lower fractions of Mo, a metal known to decrease saturation magnetization, and higher fractions of Fe; both a lower fraction of Mo and a higher fraction of Fe would promote higher saturation magnetization. All of the newly developed compositions are seen to exhibit higher saturation magnetization compared to the initial $Fe_{70}Ni_5Mo_5P_{12.5}C_5B_{2.5}$ composition, while their coercivity and magnetic remanence values remain low enough such that their magnetic behavior is considered soft. Moreover, all of the new alloys exhibit glass forming ability and toughness comparable to the initial $Fe_{70}Ni_5Mo_5P_{12.5}C_5B_{2.5}$ composition (3-5 mm critical rod diameters and 40-50 MPa $m^{1/2}$ toughness). Hence, the new alloys emerge as promising candidates for fabricating high performance bulk ferromagnetic glassy cores with substantial toughness.

In summary, the Fe-based alloys of this embodiment incorporate Co and Si in addition to the other elements described in previous embodiments of the instant invention, all in combinations that result in glass forming alloys capable of forming amorphous rods with diameters of at least 3 mm. Use of Co and Si is expected to improve the magnetic properties of the amorphous alloys. In particular, to achieve formation of amorphous rods with diameters of at least 3 mm, introduction of Co and Si in the iron-based compositions claimed in the instant invention should be performed according the following formula:

$$(Fe_{80-x-y-z}Mo_xNi_yCo_z)(P_{12.5-a}Si_a)C_5B_{2.5} \quad \text{(EQ. 2)}$$

where $0 \le a \le 1.5$ and $0 \le z \le 6$, but wherein if $0 \le a < 0.5$ then $4.5 < x < 5.5$ and $y = m - kz$ (where $4 < m < 6$ and $0.5 \le k \le 1$); and if $0.5 \le a \le 1.5$ then $3.5 < x < 4.5$ and $2.5 \le y \le 4.5$. Preferably, where $0 \le a \le 0.5$ and $0 \le z \le 5$, then $x \approx 5$ and $2 \le y \le 5$, and where $0.5 \le a \le 1.5$ and $0 \le z \le 5$, then $x \approx 4$ and $y \approx 3$ Methodology In forming the exemplary alloys, high purity (99.9% or better) Fe, Ni, Co, and Mo slugs together with P, B, Si lump and graphite powder were utilized. Appropriate amounts of each element (approximately 3 g) were weighed with an accuracy of ±0.0001 g, placed in a quartz tube, and sealed under an argon atmosphere. The elements were melted together inside the quartz tube using an induction coil, and subsequently water quenched to obtain homogeneous ingots. Alloys with higher than a 0.1% mass loss are discarded.

Ingots of alloys containing Si are fluxed with $B_2O_3$ powder in a quartz tube sealed at one end and connected to argon atmosphere on the other end. Specifically, the alloy ingot is placed on top of the $B_2O_3$ powder and the tube is placed in an induction coil to heat the ingot to about 100-200° C. above the alloy liquidus temperature (about 1100-1200° C.). The molten alloy and molten boron oxide are allowed to interact for about 1000 s, and subsequently the mixture is quenched by placing the tube in cool water.

Finally, the alloy ingots are cast in cylindrical rods with diameters of 3, 4, and 5 mm. For this step, quartz tubes with the appropriate inner diameter having 0.5-mm thick walls are used. The alloy ingot is placed inside the quartz tube under vacuum and the quartz tube is placed inside a furnace at a temperature of 1050° C. or higher to melt the ingot. Positive argon pressure pushes the molten alloy to fill the tube and the alloy is then quenched by placing the tube in cool water. The result is an alloy in rod shape with the specified cross-sectional diameter. The alloys that formed amorphous rods at 3 mm were analyzed with several diagnostic tools. including X-ray diffraction (XRD) and differential scanning calorimetry (DSC).

Glass Forming

Figure 6:
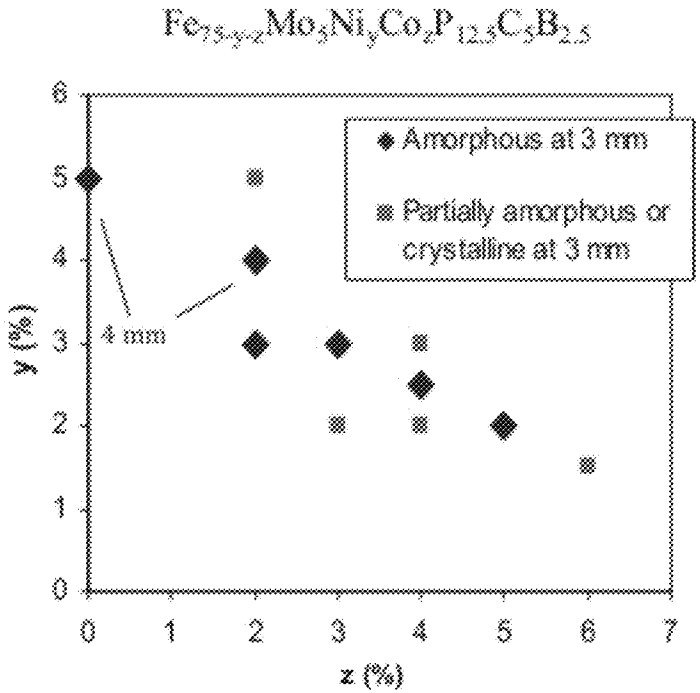
FIG. 6 provides a compositional map of $Fe_{75-y-z}Mo_5Ni_yCo_zP_{12.5}C_5B_{2.5}$ compositions depicting the ability to form amorphous rods with diameter of 3 mm.
Figure 7:
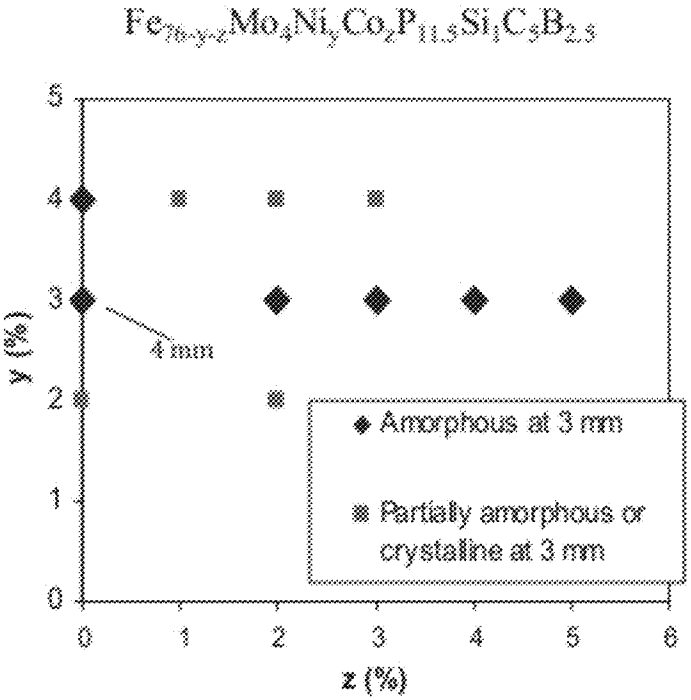
FIG. 7 provides a compositional map of $Fe_{76-y-z}Ni_yCo_zMo_4P_{11.5}C_5B_{2.5}Si_1$ compositions depicting the ability to form amorphous rods with diameter of 3 mm.

Exemplary alloy compositions represented by the formula given above, and capable of forming glassy rods with diameters of 3 mm or more are tabulated in Table 2, below, along with thermodynamic data for the glass transition, solidus, and liquidus temperatures listed for each composition. In FIGS. 6 and 7 compositional maps of multiple compositions represented by the above formula having a=0 and a=1 are plotted. As shown in the plots, only alloy compositions whose x, y, and z fall within the disclosed ranges are able to form amorphous rods having diameters of at least 3 mm. A sample XRD diffractogram and a DSC scan for an amorphous 3 mm rod with composition $Fe_{68}Ni_3Co_5Mo_4P_{11.5}C_5B_{2.5}Si_1$ are presented in FIGS. 8 and 9.

TABLE 2

Exemplary alloys represented by the formula of EQ. 2

| Composition | $D_c$ (mm) | $T_g$ (° C.) | $T_s$ (° C.) | $T_l$ (° C.) |
|---|---|---|---|---|
| $Fe_{70}Ni_5Mo_5P_{12.5}C_5B_{2.5}$ | 4 | 418 | 928 | 986 |
| $Fe_{69}Ni_4Co_2Mo_5P_{12.5}C_5B_{2.5}$ | 4 (~5) | 427 | 936 | 990 |
| $Fe_{70}Ni_3Co_2Mo_5P_{12.5}C_5B_{2.5}$ | 3 | 423 | 930 | 990 |
| $Fe_{69}Ni_3Co_3Mo_5P_{12.5}C_5B_{2.5}$ | 3 | 435 | 933 | 998 |
| $Fe_{68.5}Ni_{2.5}Co_4Mo_5P_{12.5}C_5B_{2.5}$ | 3 | 430 | 931 | 998 |
| $Fe_{68}Ni_2Co_5Mo_5P_{12.5}C_5B_{2.5}$ | 3 | 427 | 930 | 993 |
| $Fe_{72}Ni_4Mo_4P_{11.5}C_5B_{2.5}Si_1$ | 3 | 425 | 937 | 981 |
| $Fe_{73}Ni_3Mo_4P_{11.5}C_5B_{2.5}Si_1$ | 4 | 424 | 937 | 987 |
| $Fe_{71}Ni_3Co_2Mo_4P_{11.5}C_5B_{2.5}Si_1$ | 3 | 427 | 939 | 987 |
| $Fe_{70}Ni_3Co_3Mo_4P_{11.5}C_5B_{2.5}Si_1$ | 3 | 435 | 943 | 988 |
| $Fe_{69}Ni_3Co_4Mo_4P_{11.5}C_5B_{2.5}Si_1$ | 3 | 434 | 940 | 994 |
| $Fe_{68}Ni_3Co_5Mo_4P_{11.5}C5B_{2.5}Si_1$ | 3 | 426 | 936 | 979 |

In summary, the alloy $Fe_{70}Ni_5Mo_5P_{12.5}C_5B_{2.5}$, the base composition, has a critical rod diameter ($D_c$) of 4 mm, meaning that it is able to form amorphous rods with diameters up to 4 mm. Si was first added into the starting composition in the form of $Fe_{80-x-y}Ni_yMo_xP_{12.5-a}C_5B_{2.5}Si_a$. Values of "a" of 0.5, 1.0, and 1.5% were attempted. Glass forming ability was found to peak when a=1. Also, the glass forming ability was found to be maximum when x is kept at 4, in contrast to the original Si-free version which required x=5. Lastly, a high glass forming ability was found for y=4, but an even higher for y=3. These are also in contrast to the starting Si-free composition, which required y=5. Specifically, the alloy $Fe_{72}Ni_4Mo_4P_{11.5}C_5B_{2.5}Si_1$ has a $D_c$ of 3 mm, while alloy $Fe_{73}Ni_3Mo_4P_{11.5}C_5B_{2.5}Si_1$ has a $D_c$ of 4 mm and was partially amorphous at 5 mm. Other compositions with different a, x, and y were found to have significantly worse GFA.

As mentioned above, all alloys containing Si need to be fluxed, or else the GFA is significantly reduced. For example, unfluxed $Fe_{72}Ni_4Mo_4P_{11.5}C_5B_{2.5}Si_1$ cannot form an amorphous rod at 3 mm. Fluxing of alloys without Si was found to have negligible effect on their GFA, and was therefore not applied.

Next, Co was added to the alloys without Si. For such addition, the fraction of Mo to maximize glass forming ability was found to be independent of the fraction of Co, and unchanged compared to the Co-free starting composition. Co additions at the expense of either Fe or Ni or both were attempted. Adding 2% Co in place of Fe ($Fe_{68}Ni_5Co_2Mo_5P_{12.5}C_5B_{2.5}$) did not form an amorphous rod at 3 mm. Adding 2% Co by replacing 1% of Fe and 1% of Ni ($Fe_{69}Ni_4Co_2Mo_5P_{12.5}C_5B_{2.5}$) resulted in a $D_c$ of 4 mm and was partially amorphous at 5 mm. Adding 2% of Co in place of Ni, ($Fe_{70}Ni_3Co_2Mo_5P_{12.5}C_5B_{2.5}$) resulted in a $D_c$ of 3 mm. Therefore, the best glass forming ability was obtained when Co was added by replacing both Fe and Ni. Therefore, Co is added up to 5% in the form of $Fe_{75-y-z}Ni_yCo_zMo_5P_{12.5}C_5B_{2.5}$, resulting in a number of alloys, each with a $D_c$ of 3 mm: $Fe_{69}Ni_3Co_3Mo_5P_{12.5}C_5B_{2.5}$, $Fe_{68.5}Ni_{2.5}Co_4Mo_5P_{12.5}C_5B_{2.5}$, and $Fe_{68}Ni_2Co_5Mo_5P_{12.5}C_5B_{2.5}$. This trend of varying the amount of Ni and Co to maintain a $D_c$ of 3 mm is shown in FIG. 6. Hence, the trend in y and z is:

$$y=5-kz, \quad \text{(EQ. 3)}$$

where k is from 0.5 to 1, and preferably 0.5.

Lastly, Co was added to the alloy containing 1% Si. For such an addition, the fraction of Mo to maximize glass forming ability was found to be 4, independent of the fraction of Co. Additions in the form of $Fe_{76-y-z}Ni_yCo_zMo_4P_{11.5}C_5B_{2.5}Si_1$ were also attempted. For these additions, the glass forming ability is maximized when y is kept at 3, independent of z. Variations in z ranging from 2% to 5% in 1% intervals with y=3 were attempted. The ability of these compositions to maintain a $D_c$ of 3 mm is presented in FIG. 7.

Figure 8:
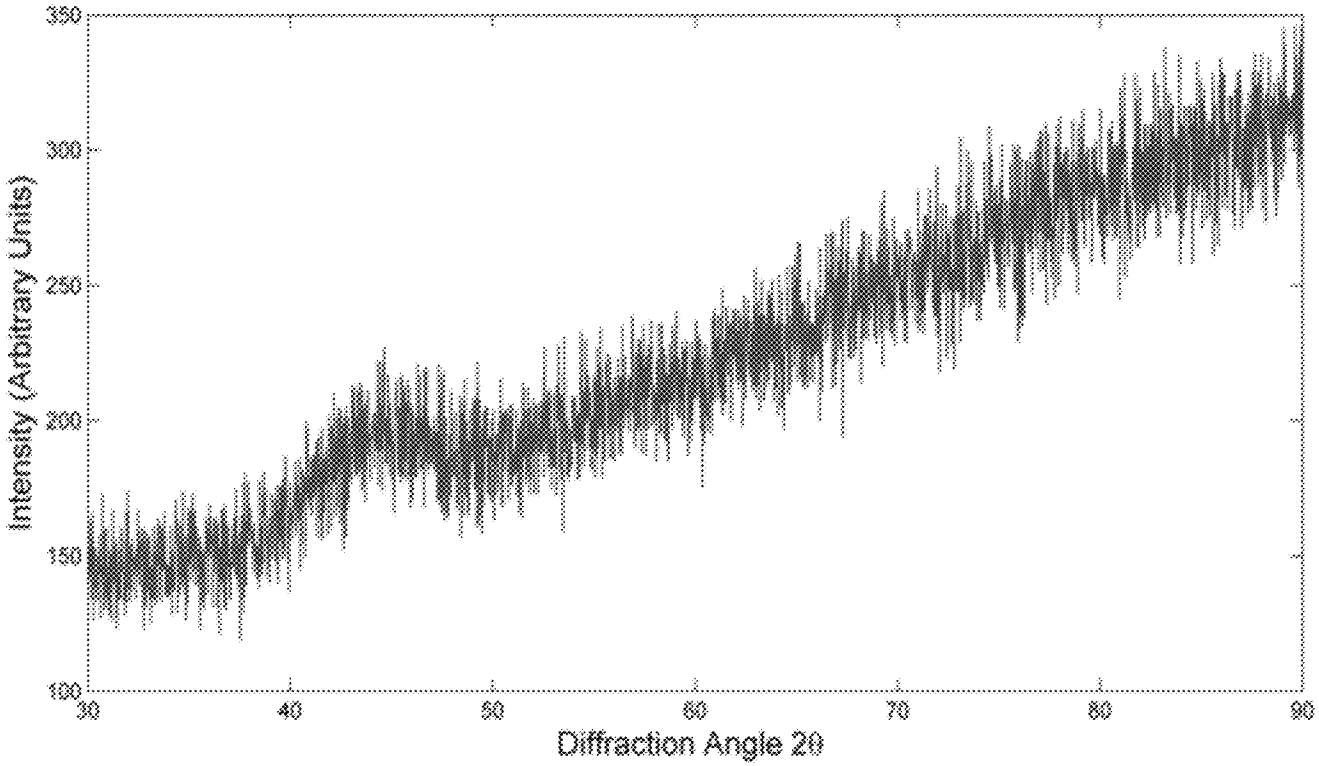
FIG. 8 provides an X-ray diffractogram verifying the amorphous nature of a 3-mm disk of composition $Fe_{68}Ni_3Co_5Mo_4P_{11.5}C_5B_{2.5}Si_1$.
Figure 9:
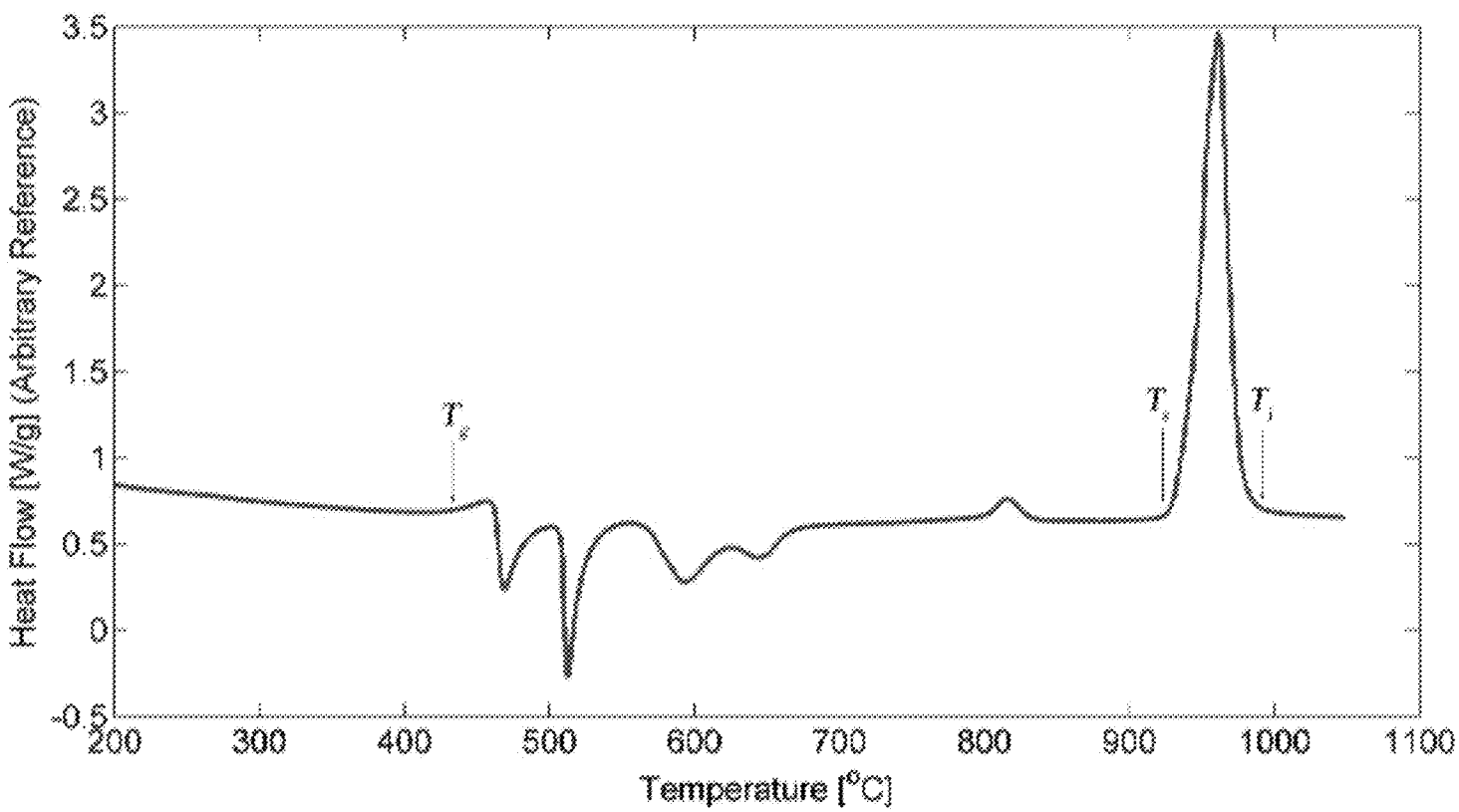
FIG. 9 provides a differential calorimetry scan of amorphous $Fe_{68}Ni_3Co_5Mo_4P_{11.5}C_5B_{2.5}Si_1$ (glass transition, solidus, and liquidus temperatures $T_g$, $T_s$, and $T_l$, are designated)
Figure 10:
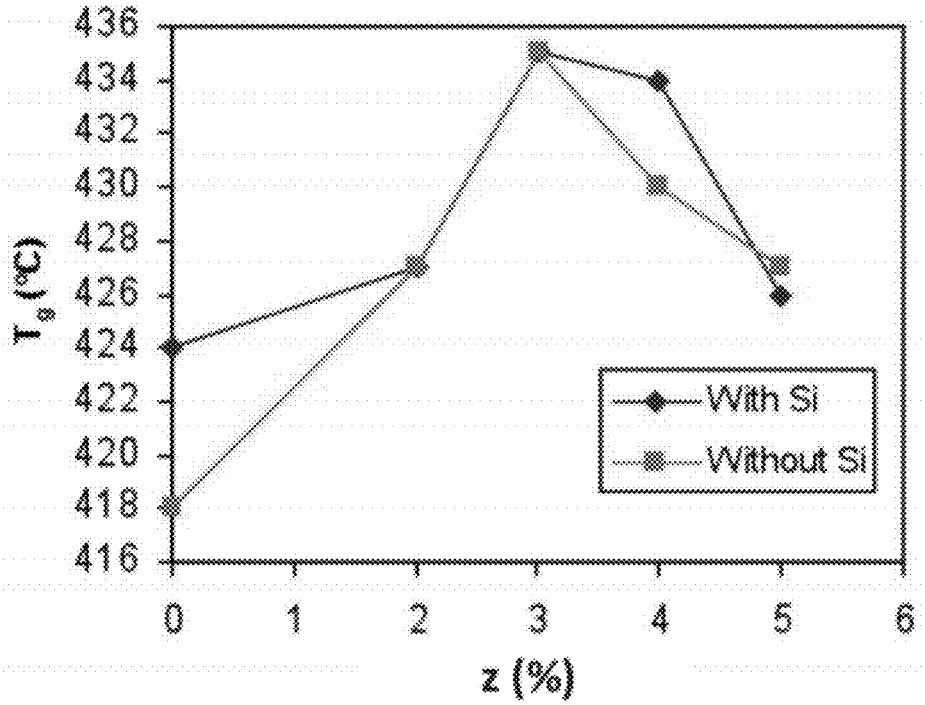
FIG. 10 provides data graphs plotting glass transition temperature (° C.) versus fraction of Co in $Fe_{75-z-y}Ni_yCo_zMo_5P_{12.5}C_5B_{2.5}$ ($2<y<5$), and $Fe_{73-z}Ni_3Co_zMo_4P_{11.5}C_5B_{2.5}Si_1$.

The amorphous structure of the 3 mm rods is supported by XRD, all of which do not have sharp peaks, indicating an absence of any crystallinity. An XRD for $Fe_{68}Ni_3Co_5Mo_4P_{11.5}C_5B_{2.5}Si_1$ is shown in FIG. 8. The DSC scans of the amorphous rods show a steep glass transition temperature and a large latent energy of crystallization, which further support the amorphous state of these alloys. A DSC scan for $Fe_{68}Ni_3Co_5Mo_4P_{11.5}C_5B_{2.5}Si_1$ is shown in FIG. 9. For each alloy, the glass transition temperature ($T_g$), solidus temperature ($T_s$), and liquidus temperature ($T_l$) were estimated, and are summarized in FIGS. 10-12 and tabulated in Table 2.

Figure 11:
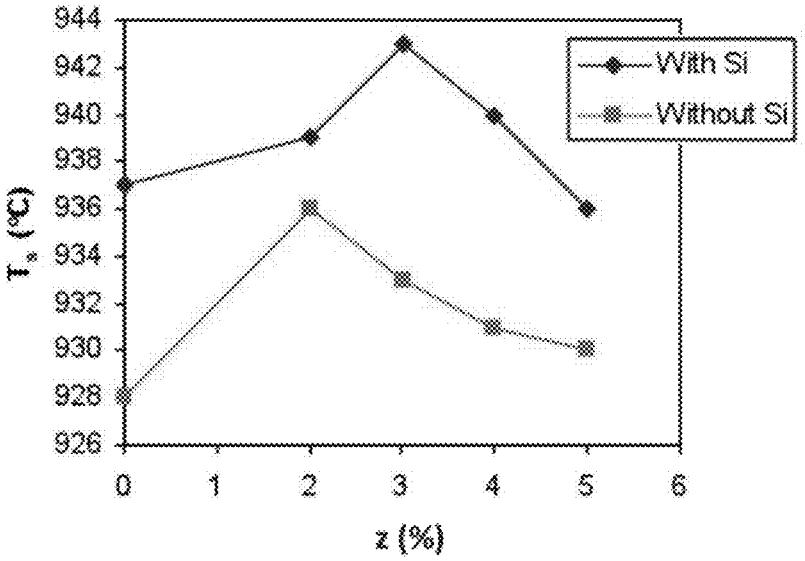
FIG. 11 provides a data graph plotting solidus temperature (° C.) versus fraction of Co in $Fe_{75-z-y}Ni_yCo_zMo_5P_{12.5}C_5B_{2.5}$ ($2<y<5$), and in $Fe_{73-z}Ni_3Co_zMo_4P_{11.5}C_5B_{2.5}Si_1$.
Figure 12:
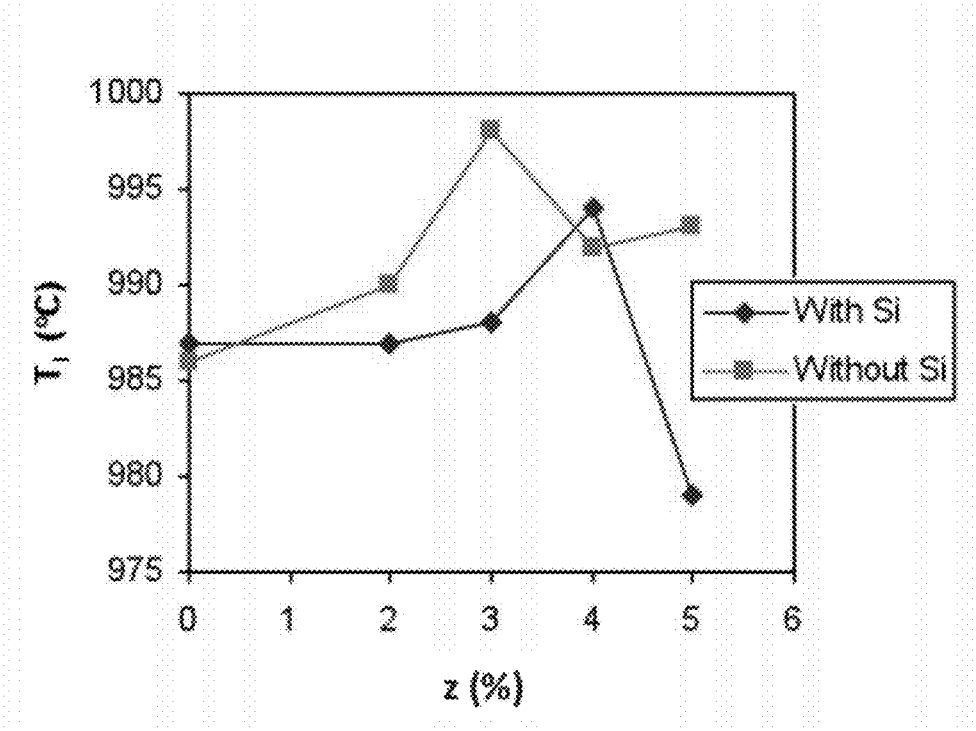
FIG. 12 provides a data graph plotting liquidus temperature (° C.) versus fraction of Co in $Fe_{75-z-y}Ni_yCo_zMo_5P_{12.5}C_5B_{2.5}$ ($2<y<5$), and $Fe_{73-z}Ni_3Co_zMo_4P_{11.5}C_5B_{2.5}Si_1$.

The $T_g$, the point at which the material begins transitioning from a glassy to a liquid state and ultimately to a crystalline state, represents the upper limit of the magnetic material's operating temperature, and ranges from 418° C. to 435° C. It is clear from FIG. 10 that $T_g$ peaks at 3% Co for both the alloys with and without Si. Likewise, as shown in FIGS. 11 and 12, $T_s$ and $T_l$ of alloys with and without Si peak around 2-4% Co.

Magnetic Properties

Figure 13:
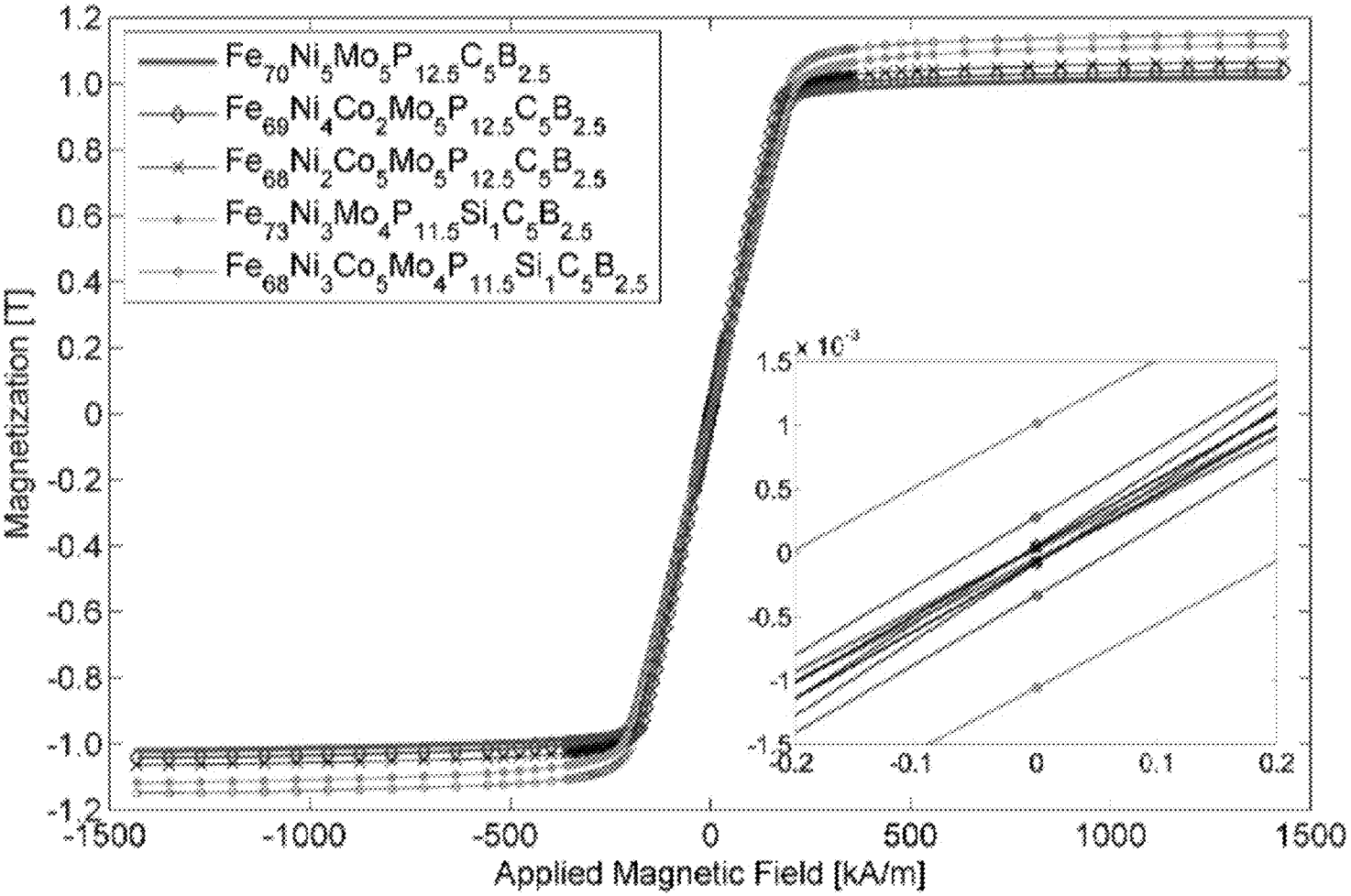
FIG. 13 provides a data graph plotting magnetization vs. applied magnetic field for exemplary alloys of the present invention, and where the inset is a plot around zero applied field.
Figure 14:
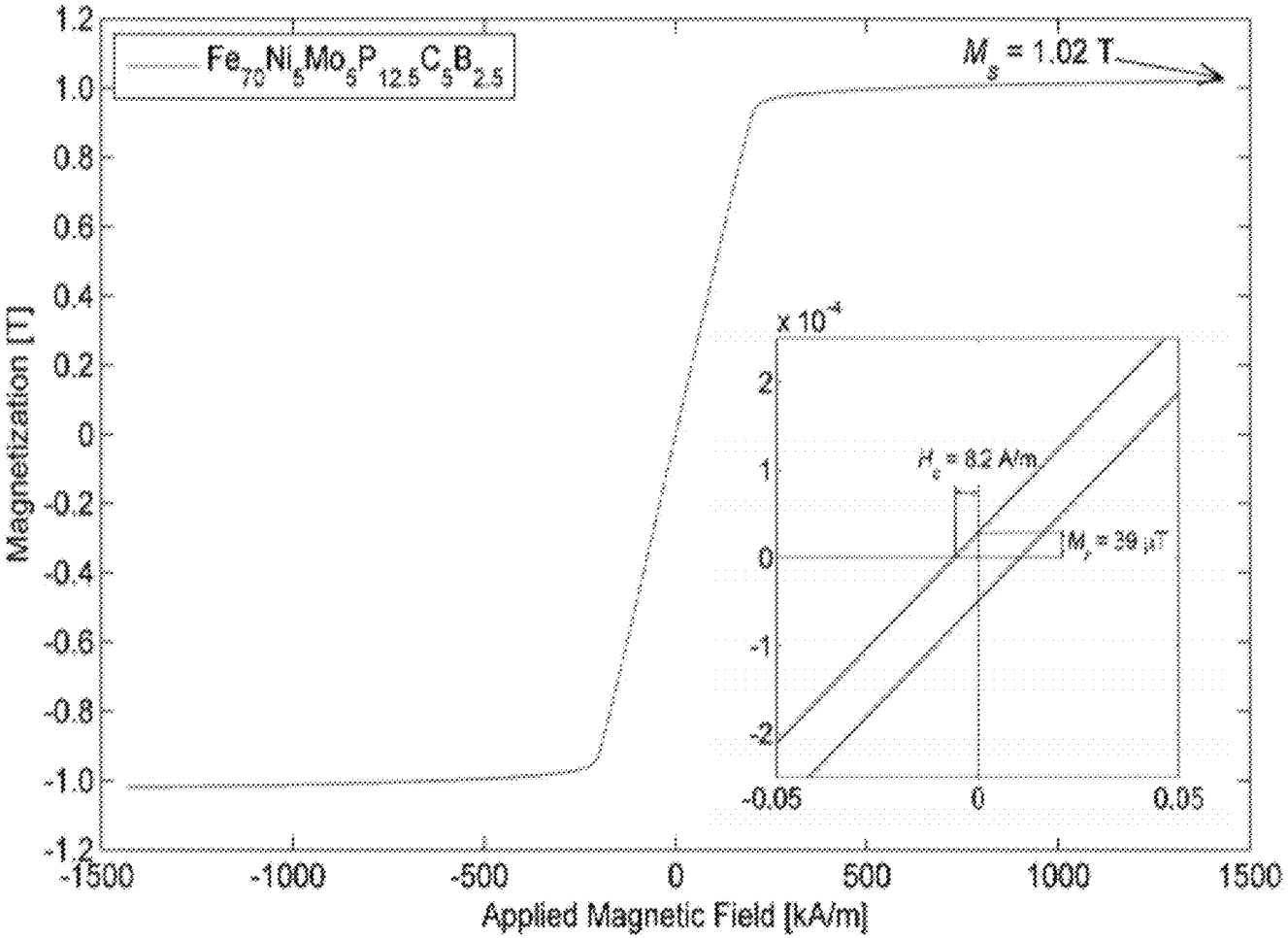
FIG. 14 provides a data graph plotting magnetization vs. applied magnetic field for alloy $Fe_{70}Ni_5Mo_5P_{12.5}C_5B_{2.5}$, and where the inset is a plot around zero applied field (values for the saturation magnetization $M_s$, coercivity $H_c$ and retentivity $M_r$ are designated)

Magnetic measurements at 30° C. were performed for five of the inventive amorphous alloys: $Fe_{70}Ni_5Mo_5P_{12.5}C_5B_{2.5}$, the starting alloy without Co or Si; $Fe_{69}Ni_4Co_2Mo_5P_{12.5}C_5B_{2.5}$, which has the highest GFA of all the alloys produced; $Fe_{68}Ni_2Co_5Mo_5P_{12.5}C_5B_{2.5}$ and $Fe_{68}Ni_3Co_5Mo_4P_{11.5}C_5B_{2.5}Si_1$, which have the largest amount of Co in their respective systems; and $Fe_{73}Ni_3Mo_4P_{11.5}C_5B_{2.5}Si_1$, which has the largest GFA among the alloys containing Si. The plots of magnetization vs. applied magnetic field, M vs. H, for each alloy are presented in FIG. 13. In the inset of FIG. 13, the response around H=0 is presented to observe the width of the hysteresis loop for each alloy. In FIG. 14, a sample M-H curve for alloy $Fe_{70}Ni_5Mo_5P_{12.5}C_5B_{2.5}$ is presented showing how the values for the saturation magnetization $M_s$, coercivity $H_c$ and retentivity $M_r$ are calculated. These values are calculated for each alloy and are listed in Table 3, along with magnetic data for the saturation magnetization, coercivity, and retentivity are listed for each composition.

TABLE 3

Magnetic Measurements

| Composition | $D_c$ (mm) | $M_s$ (T) | $H_c$ (A/m) | $M_r$ (T) |
|---|---|---|---|---|
| $Fe_{70}Ni_5Mo_5P_{12.5}C_5B_{2.5}$ | 4 | 1.02 | 8.161 | $3.90 \times 10^{-5}$ |
| $Fe_{69}Ni_4Co_2Mo_5P_{12.5}C_5B_{2.5}$ | 4 (~5) | 1.04 | 11.43 | $6.88 \times 10^{-5}$ |
| $Fe_{68}Ni_2Co_5Mo_5P_{12.5}C_5B_{2.5}$ | 3 | 1.06 | 10.89 | $5.76 \times 10^{-5}$ |
| $Fe_{73}Ni_3Mo_4P_{11.5}C_5B_{2.5}Si_1$ | 4 | 1.12 | 209.1 | $103 \times 10^{-5}$ |
| $Fe_{68}Ni_3Co_5Mo_4P_{11.5}C_5B_{2.5}Si_1$ | 3 | 1.15 | 57.01 | $30.7 \times 10^{-5}$ |

As seen in FIG. 14 and Table 3, compositions that bear either Co or Si or both exhibit an $M_s$ value higher than the Co and Si free alloy $Fe_{70}Ni_5Mo_5P_{12.5}C_5B_{2.5}$. Also, the Co-bearing Si-free alloys appear to exhibit values for $H_c$ and $M_r$ that are nearly as low as $Fe_{70}Ni_5Mo_5P_{12.5}C_5B_{2.5}$, but the Si-bearing Co-free alloy exhibits higher $H_c$ and $M_r$ values. The addition of Si has the most significant effect on $M_s$, which increases from 1.02 to 1.12 T in $Fe_{70}Ni_5Mo_5P_{12.5}C_5B_{2.5}$ and $Fe_{73}Ni_3Mo_4P_{11.5}C_5B_{2.5}Si_1$, respectively. It is not clear whether the increase in $M_s$ can be attributed solely to the presence of Si, or solely to a higher Fe content and lower Mo content in the Si containing alloy, or a combination of the above. Additions of Co have a smaller effect, but still increase $M_s$. 5% of Co in the $Fe_{75-x-y}Ni_yCo_xMo_5P_{12.5}C_5B_{2.5}$ system increases $M_s$ from 1.02 to 1.06 T, while 5% of Co in the $Fe_{73-z}Ni_3Co_zMo_4P_{11.5}C_5B_{2.5}Si_1$ system increases $M_s$ from 1.12 to 1.15 T.

In the alloys without Si, $H_c$ ranged from 8.16 to 11.43. While 2% Co raised $H_c$ to 11.43 A/m, 5% Co decreased it back to 10.89 A/m, suggesting that larger amounts of Co may continue to decrease H. The addition of Si as $Fe_{73}Ni_3Mo_4P_{11.5}C_5B_{2.5}Si_1$ increased $H_c$ by a considerable amount to 209.1 A/m. However, the addition of 5% Co, $Fe_{68}Ni_3Co_5Mo_4P_{11.5}C_5B_{2.5}Si_1$, decreased it back to 57 A/m, also suggesting that $H_c$ may be decreased even further with further increasing Co. With all of these alloys, $M_r$ behaves in a manner similar to H. Thus, although $M_s$ is increased through the addition of Si by a large amount, $H_c$ also experiences an increase. However, moderate additions of Co (at least 5%) may decrease $H_c$ while increasing M.

Figure 15:
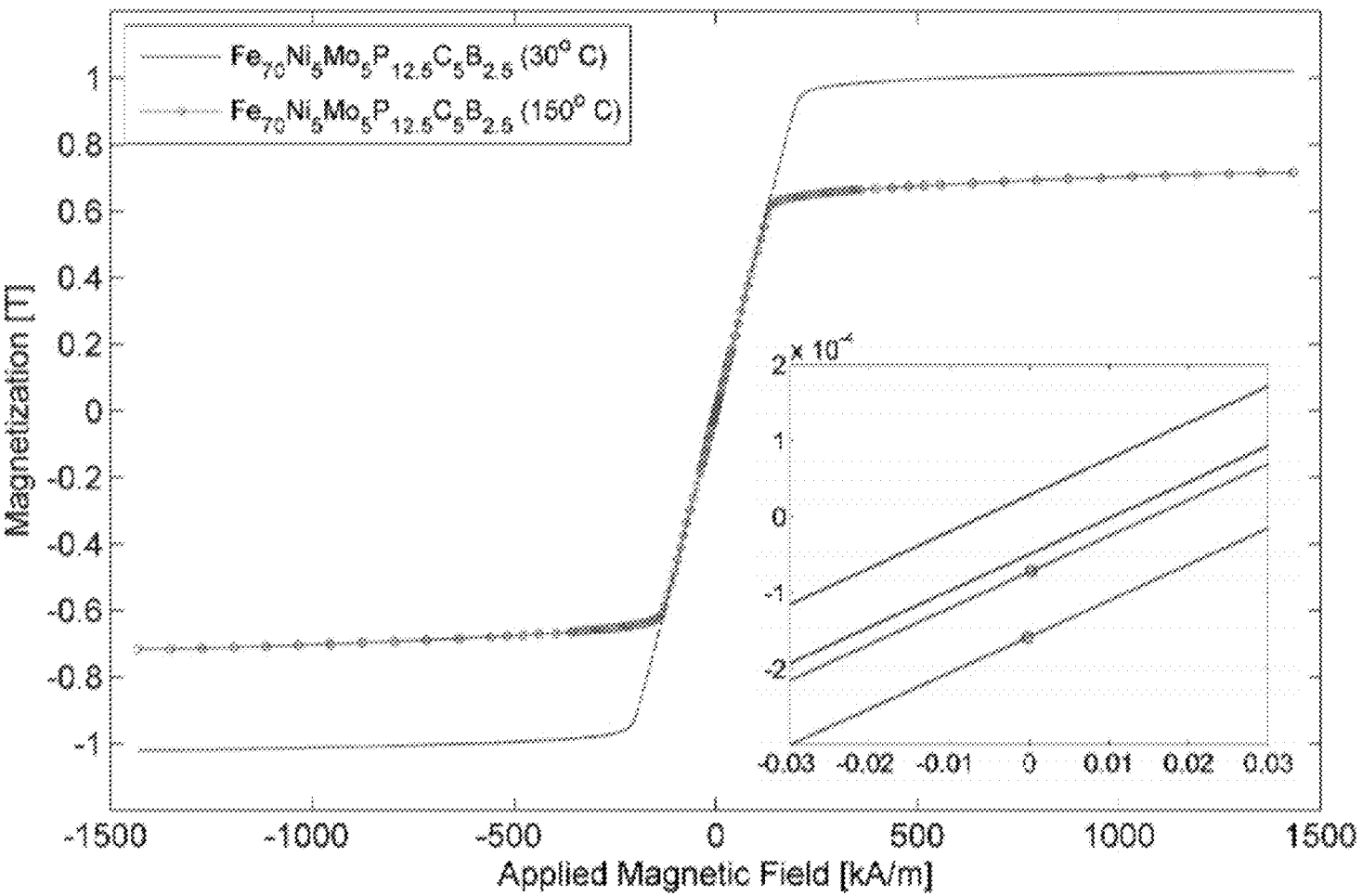
FIG. 15 provides data plots of M-H curves for alloy $Fe_{70}Ni_5Mo_5P_{12.5}C_5B_{2.5}$ showing how the saturation magnetization $M_s$, coercivity H, and retentivity $M_r$ vary with increasing temperature.

To investigate the effect of temperature, magnetic measurements were also performed at 150° C. for three of the inventive amorphous alloys: $Fe_{70}Ni_5Mo_5P_{12.5}C_5B_{2.5}$, $Fe_{68}Ni_2Co_5Mo_5P_{12.5}C_5B_{2.5}$ and $Fe_{68}Ni_3Co_5Mo_4P_{11.5}C_5B_{2.5}Si_1$. In FIG. 15, a sample M-H curve for alloy $Fe_{70}Ni_5Mo_5P_{12.5}C_5B_{2.5}$ is presented showing how the values for the saturation magnetization $M_s$, coercivity H, and retentivity $M_r$ vary with increasing temperature. These values are listed for the three alloys in Tables 4-6. It appears that raising temperature dramatically decreases $M_s$. This is expected, because as the Curie point temperature of the magnetic alloy is approached (for these alloys it is expected to lie between 300 and 400° C.), $M_s$ should approach zero. The effect of increasing temperature on H, and $M_r$ is smaller; it appears to very slightly increase these values in the Si-free alloys $Fe_{70}Ni_5Mo_5P_{12.5}C_5B_{2.5}$ and $Fe_{68}Ni_2Co_5Mo_5P_{12.5}C_5B_{2.5}$, while the increase is somewhat more pronounced in Si-bearing alloy $Fe_{68}Ni_3Co_5Mo_4P_{11.5}C_5B_{2.5}Si_1$.

TABLE 4

| Saturation magnetization $M_s$ (T) | | |
|---|---|---|
| Composition | 30° C. | 150° C. |
| $Fe_{70}Ni_5Mo_5P_{12.5}C_5B_{2.5}$ | 1.02 | 0.72 |
| $Fe_{68}Ni_2Co_5Mo_5P_{12.5}C_5B_{2.5}$ | 1.06 | 0.79 |
| $Fe_{68}Ni_3Co_5Mo_4P_{11.5}C_5B_{2.5}Si_1$ | 1.15 | 0.91 |

TABLE 5

| Coercivity $H_c$ (A/m) | | |
|---|---|---|
| Composition | 30° C. | 150° C. |
| $Fe_{70}Ni_5Mo_5P_{12.5}C_5B_{2.5}$ | 8.161 | 8.916 |
| $Fe_{68}Ni_2Co_5Mo_5P_{12.5}C_5B_{2.5}$ | 10.89 | 12.29 |
| $Fe_{68}Ni_3Co_5Mo_4P_{11.5}C_5B_{2.5}Si_1$ | 57.01 | 78.01 |

TABLE 6

| Retentivity $M_r$ (T) | | |
|---|---|---|
| Composition | 30° C. | 150° C. |
| $Fe_{70}Ni_5Mo_5P_{12.5}C_5B_{2.5}$ | $3.90 \times 10^{-5}$ | $4.27 \times 10^{-5}$ |
| $Fe_{68}Ni_2Co_5Mo_5P_{12.5}C_5B_{2.5}$ | $5.76 \times 10^{-5}$ | $6.26 \times 10^{-5}$ |
| $Fe_{68}Ni_3Co_5Mo_4P_{11.5}C_5B_{2.5}Si_1$ | $30.7 \times 10^{-5}$ | $41.2 \times 10^{-5}$ |

Figure 16:
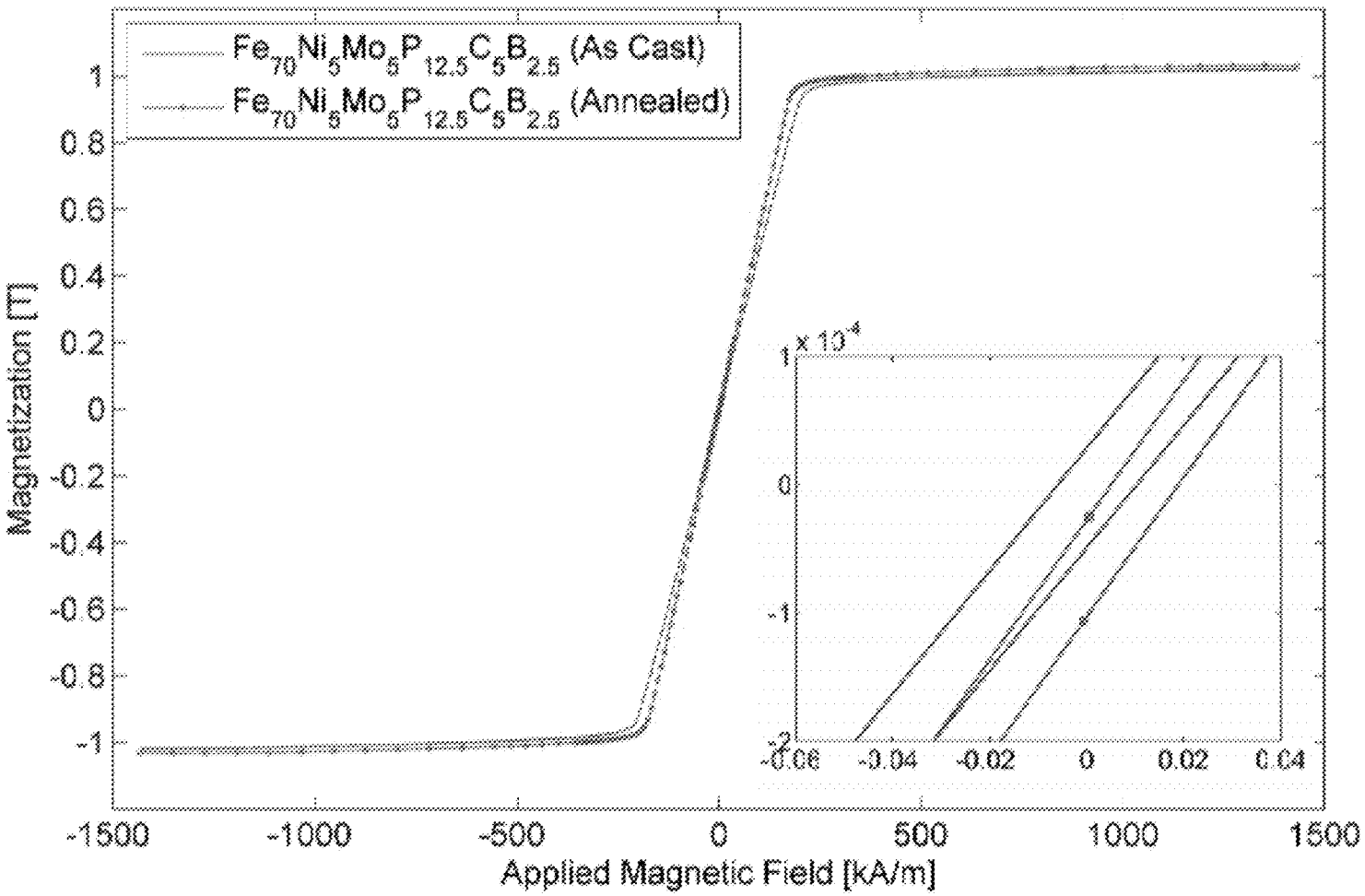
FIG. 16 provides data plots of M-H curves for alloy $Fe_{70}Ni_5Mo_5P_{12.5}C_5B_{2.5}$ showing how annealing affects the saturation magnetization $M_s$, coercivity $H_c$ and retentivity $M_r$.

To relieve the effect of magnetostriction, which arises in amorphous ferromagnetic alloys due to residual stresses that develop in the glassy structure during quenching, the samples were annealed at 375° C. for 1 hour prior to measuring their room-temperature magnetic properties. Annealing was performed inside quartz tubes sealed under an argon atmosphere, placed in a furnace at 375° C., and after being heated in that temperature for 1 hour, were removed from the surfaced and allowed to free cool in air. Three of the inventive amorphous alloys were investigated: $Fe_{70}Ni_5Mo_5P_{12.5}C_5B_{2.5}$, $Fe_{68}Ni_2Co_5Mo_5P_{12.5}C_5B_{2.5}$ and $Fe_{68}Ni_3Co_5Mo_4P_{11.5}C_5B_{2.5}Si_1$. In FIG. 16, sample M-H curves for alloy $Fe_{70}Ni_5Mo_5P_{12.5}C_5B_{2.5}$ are presented showing how annealing affects the values for the saturation magnetization $M_c$, coercivity H, and retentivity $M_r$. These values are listed for the three alloys in Tables 7-9. It appears that annealing slightly increases $M_s$ in all three alloys, which is a desirable outcome. It also noticeably decreases H, and $M_r$ in the Si-free alloys $Fe_{70}Ni_5Mo_5P_{12.5}C_5B_{2.5}$ and $Fe_{68}Ni_2Co_5Mo_5P_{12.5}C_5B_{2.5}$, which is desirable, but it increases those values in the Si-bearing alloy $Fe_{68}Ni_3Co_5Mo_4P_{11.5}C_5B_{2.5}Si_1$, which is undesirable.

TABLE 7

| Saturation magnetization $M_s$ (T) | | |
|---|---|---|
| Composition | As cast | Annealed |
| $Fe_{70}Ni_5Mo_5P_{12.5}C_5B_{2.5}$ | 1.02 | 1.03 |
| $Fe_{68}Ni_2Co_5Mo_5P_{12.5}C_5B_{2.5}$ | 1.06 | 1.07 |
| $Fe_{68}Ni_3Co_5Mo_4P_{11.5}C_5B_{2.5}Si_1$ | 1.15 | 1.17 |

TABLE 8

| Coercivity $H_c$ (A/m) | | |
|---|---|---|
| Composition | As cast | Annealed |
| $Fe_{70}Ni_5Mo_5P_{12.5}C_5B_{2.5}$ | 8.161 | 6.960 |
| $Fe_{68}Ni_2Co_5Mo_5P_{12.5}C_5B_{2.5}$ | 10.89 | 8.161 |
| $Fe_{68}Ni_3Co_5Mo_4P_{11.5}C_5B_{2.5}Si_1$ | 57.01 | 85.66 |

TABLE 9

| Retentivity $M_r$ (T) | | |
|---|---|---|
| Composition | As cast | Annealed |
| $Fe_{70}Ni_5Mo_5P_{12.5}C_5B_{2.5}$ | $3.90 \times 10^{-5}$ | $3.78 \times 10^{-5}$ |
| $Fe_{68}Ni_2Co_5Mo_5P_{12.5}C_5B_{2.5}$ | $5.76 \times 10^{-5}$ | $4.25 \times 10^{-5}$ |
| $Fe_{68}Ni_3Co_5Mo_4P_{11.5}C_5B_{2.5}Si_1$ | $30.7 \times 10^{-5}$ | $43.9 \times 10^{-5}$ |

Summary

In summary, in this embodiment, novel bulk amorphous ferromagnetic alloys with a balance of good GFA, toughness, and soft magnetic performance have been produced in the Fe—(Ni,Co)—Mo—(P,Si)—C—B system. These Fe-based alloys are able to form amorphous rods at thicknesses two orders of magnitude higher than commercial amorphous ferromagnetic alloys—while the commercial alloys have a $D_c$ of at most 100 μm, this project has found alloys with a $D_c$ of 3 and 4 mm. The alloys in these systems demonstrate good magnetic properties together with high toughness, as opposed to other amorphous ferromagnetic alloys with comparable GFA that demonstrate comparable magnetic properties but inferior toughness. These alloys have a high $M_s$ of up to 1.15 T and low coercivity and retentivity. Additionally, expensive or toxic elements such as Ga have been avoided, which is a common component of alloys with both high GFA and good soft magnetic properties.

These alloys serve as a basis for the development of a new class of ferromagnetic bulk amorphous alloys. The alloys produced have excellent magnetic and mechanical properties which may allow them to be used as monolithic soft magnetic cores in power electronics applications that require high efficiencies, compact sizes, high toughness and fatigue resistance, and low fabrication costs. Potential applications include, but are not limited to inductors, transformers, clutches, and DC/AC converters.

CONCLUSION

In summary, the inventive Fe-based, P-containing metallic glasses demonstrate an optimum toughness-glass forming ability relation. Specifically, the inventive alloys demonstrate higher toughness for a given critical rod diameter than any other prior art alloys. This optimum relation, which is unique in Fe-based systems, is a consequence of a low shear modulus achieved by very tightly controlling the fractions of C and B in the compositions of the inventive alloys.

The unique combination of high glass-forming ability and toughness associated with the inventive alloys make them excellent candidates for use as structural elements in a number of applications, specifically in the fields of consumer electronics, automotive, and aerospace. In addition to a good glass-forming ability and toughness, the inventive Fe-based alloys demonstrate a higher strength, hardness, stiffness, and corrosion resistance than commercial Zr-based glasses, and are of much lower cost. Therefore, the inventive alloys are well suited for components for mobile electronics requiring high strength, stiffness, and corrosion and scratch resistance, which include but are not limited to casing, frame, housing, hinge, or any other structural component for a mobile electronic device such as a mobile telephone, personal digital assistant, or laptop computer. In addition, these alloys do not contain elements that are known to cause adverse biological reactions. Specifically, they are free of Cu and Be, and certain compositions can be formed without Ni or Al, all of which are known to be associated with adverse biological reactions. Accordingly, it is submitted that the inventive materials could be well-suited for use in biomedical applications, such as, for example, medical implants and instruments, and the invention is also directed to medical instruments, such as surgical instruments, external fixation devices, such as orthopedic or dental wire, and conventional implants, particularly load-bearing implants, such as, for example, orthopedic, dental, spinal, thoracic, cranial implants made using the inventive alloys. The combination of high scratch and corrosion resistance, biocompatibility, and an attractive "white" color make the alloy well suited for jewelry applications, such as, for example, watches, rings, necklaces, earrings, bracelets, cuf-flinks, as well as casings and packaging for such items.

Finally, these materials also demonstrate soft ferromagnetic properties, indicating that they would be well suited for applications requiring soft magnetic properties, such as, for example, in electromagnetic shielding or transformer core applications. A number of new alloys have been synthesized with critical diameters for glass formation of 3 and 4 mm in the system Fe—(Ni, Co)—Mo—(P,Si)—C—B. Using a Vibrating Sample Magnetometer, saturation magnetization values as high as 1.15 T have been measured, while low coercivities and magnetic remenences have been recorded. These results, taken together, suggest that the developed bulk-glass forming compositions are excellent candidate materials for low-cost fabrication of high-efficiency, compact-size, tough ferromagnetic cores for power electronics applications.

DOCTRINE OF EQUIVALENTS

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A ferromagnetic Fe-based metallic glass formed of an alloy comprising at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5;

further comprising at least Mo and Ni, and optionally Co and Si; and wherein the concentrations of Mo and Ni vary in accordance with the concentration of Co and Si as follows:

where Si comprises an atomic percent of from 0 to 0.5 and Co comprises an atomic percent of from 0 to 6, then Mo comprises an atomic percent of from 4.5 to 5.5, and Ni comprises an atomic percent in a range as defined by the following equation:

m-k·z, where m ranges from 4 to 6, k ranges from 0.5 to 1, and z represents the atomic percent of Co, and where Si comprises an atomic percent of from 0.5 to 1.5 and Co comprises an atomic percent of from 0 to 6, then Mo comprises an atomic percent of from 3.5 to 4.5 and Ni comprises an atomic percent of from 2.5 to 4.5, and wherein the alloy has a critical rod diameter of at least 3 mm.

2. The metallic glass of claim 1, wherein the atomic percent of P is from 10 to 13.

3. The metallic glass of claim 1, wherein the atomic percent of P is about 12.5.

4. The metallic glass of claim 1, wherein the atomic percent of C is from 4.5 to 5.5.

5. The metallic glass of claim 1, wherein the atomic percent of C is about 5.

6. The metallic glass of claim 1, wherein the atomic percent of B is from 2 to 3.

7. The metallic glass of claim 1, wherein the atomic percent of B is about 2.5.

8. The metallic glass of claim 1, wherein if Si comprises an atomic percent of from 0 to 0.5 and Co comprises an atomic percent of from 0 to 5, Mo comprises an atomic percent of about 5 and Ni comprises an atomic percent ranging from about 2 to about 5.

9. The metallic glass of claim 1, wherein if Si comprises an atomic percent of from 0.5 to 1.5 and Co comprises an atomic percent of from 0 to 5, Mo comprises an atomic percent of about 4 and Ni comprises an atomic percent of about 3.

10. The metallic glass of claim 1, wherein the metallic glass at room temperature has a magnetization ($M_s$) of at least 1.0 T.

11. The metallic glass of claim 1, wherein the as-cast alloy at room temperature has a coercivity ($H_c$) of less than 210 A/m, when measured on a disk sample 3 mm diameter and 1 mm in height using a vibrating sample magnetometer.

12. The metallic glass of claim 1, wherein the metallic glass at room temperature has a retentivity ($M_r$) of less than $110\times 10^{-5}$ T, when measured on a disk sample 3 mm diameter and 1 mm in height using a vibrating sample magnetometer.

13. The metallic glass of claim 1, wherein the composition further comprises Ru in an atomic percent of from 1 to 5.

14. The metallic glass of claim 1, further comprising at least one trace element wherein the total weight fraction of said at least one trace element is less than 0.02.

15. The metallic glass of claim 1, wherein the metallic glass has a glass transition temperature ($T_g$) of less than 440° C.

16. The metallic glass of claim 1, wherein the metallic glass has a shear modulus (G) of less than 60 GPa.

17. The metallic glass of claim 1, wherein the composition is selected from the group consisting of $Fe_{70}Ni_5Mo_5P_{12.5}C_5B_{2.5}$, $Fe_{69}Ni_4Co_2Mo_5P_{12.5}C_5B_{2.5}$, $Fe_{70}Ni_3Co_2Mo_5P_{12.5}C_5B_{2.5}$, $Fe_{69}Ni_3Co_3Mo_5P_{12.5}C_5B_{2.5}$, $Fe_{68.5}Ni_{2.5}Co_4Mo_5P_{12.5}C_5B_{2.5}$, $Fe_{68}Ni_2Co_5Mo_5P_{12.5}C_5B_{2.5}$, $Fe_{72}Ni_4Mo_4P_{11.5}C_5B_{2.5}Si_1$, $Fe_{73}Ni_3Mo_4P_{11.5}C_5B_{2.5}Si_1$, $Fe_{71}Ni_3Co_2Mo_4P_{11.5}C_5B_{2.5}Si_1$, $Fe_{70}Ni_3Co_3Mo_4P_{11.5}C_5B_{2.5}Si_1$, $Fe_{69}Ni_3Co_4Mo_4P_{11.5}C_5B_{2.5}Si_1$, and $Fe_{68}Ni_3Co_5Mo_4P_{11.5}C_5B_{2.5}Si_1$ where numbers denote atomic percent.

18. A method of manufacturing a metallic glass composition comprising:

providing an alloy comprising at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5;

further comprising at least Mo and Ni, and optionally Co and Si; and wherein the concentrations of Mo and Ni vary in accordance with the concentration of Co and Si as follows:

where Si comprises an atomic percent of from 0 to 0.5 and Co comprises an atomic percent of from 0 to 6, then Mo comprises an atomic percent of from 4.5 to 5.5, and Ni comprises an atomic percent in a range as defined by the following equation:

m−k·z, where m ranges from 4 to 6, k ranges from 0.5 to 1, and z represents the atomic percent of Co, and where Si comprises an atomic percent of from 0.5 to 1.5 and Co comprises an atomic percent of from 0 to 6, then Mo comprises an atomic percent of from 3.5 to 4.5 and Ni comprises an atomic percent of from 2.5 to 4.5; and melting said alloy into a molten state; and quenching said molten alloy at a cooling rate sufficiently rapid to prevent crystallization of said alloy, and wherein the alloy has a critical rod diameter of at least 3 mm.

19. The method of claim 18, wherein if the composition contains Si, the molten alloy is fluxed prior to quenching.

20. The method of claim 19, wherein the flux is boron oxide.

21. The method of claim 18, further comprising annealing the metallic glass after quenching.

22. A magnetic metallic glass object formed of an alloy comprising at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5;

further comprising at least Mo and Ni, and optionally Co and Si; and wherein the concentrations of Mo and Ni vary in accordance with the concentration of Co and Si as follows:

where Si comprises an atomic percent of from 0 to 0.5 and Co comprises an atomic percent of from 0 to 6, then Mo comprises an atomic percent of from 4.5 to 5.5, and Ni comprises an atomic percent in a range as defined by the following equation:

m−k·z, where m ranges from 4 to 6, k ranges from 0.5 to 1, and z represents the atomic percent of Co, and where Si comprises an atomic percent of from 0.5 to 1.5 and Co comprises an atomic percent of from 0 to 6, then Mo comprises an atomic percent of from 3.5 to 4.5 and Ni comprises an atomic percent of from 2.5 to 4.5, and wherein the alloy has a critical rod diameter of at least 3 mm.

23. The object of claim 22, wherein the object is a magnetic core used in the generation or conversion of electrical power.

24. The object of claim 23, wherein the magnetic core has a planar shape, a torroidal shape, a ring shape, a U shape, a C shape, an I shape, an E shape, or any combination of the above shapes.

25. The object of claim 23, wherein the magnetic core is an assembly of more than one component, and wherein each component has a cross section thickness of not less than 0.5 mm.

26. The object of claim 23, wherein the magnetic core is monolithic.

27. The object of claim 22, wherein the magnetic object has an application selected from the group consisting of inductors, transformers, clutches, and DC/AC converters.

* * * * *